US010863296B1

(12) United States Patent
Thoshkahna et al.

(10) Patent No.: US 10,863,296 B1
(45) Date of Patent: Dec. 8, 2020

(54) MICROPHONE FAILURE DETECTION AND RE-OPTIMIZATION

(71) Applicant: Amazon Technologies, Inc., Seattle, WA (US)

(72) Inventors: Balaji Nagendran Thoshkahna, Cupertino, CA (US); Trausti Thor Kristjansson, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/365,520

(22) Filed: Mar. 26, 2019

(51) Int. Cl.

| | |
|---|---|
| ***H04R 29/00*** | (2006.01) |
| ***H04R 5/04*** | (2006.01) |
| ***H04R 1/40*** | (2006.01) |
| ***H04R 5/027*** | (2006.01) |

(52) U.S. Cl.
CPC ..... *H04R 29/005* (2013.01); *H04R 1/406* (2013.01); *H04R 5/027* (2013.01); *H04R 5/04* (2013.01); *H04R 2410/07* (2013.01)

(58) Field of Classification Search
CPC ..... H04R 29/004; H04R 29/005; H04R 5/04; H04R 5/027; H04R 3/00; H04R 3/04; H04R 2460/05
USPC ..... 381/58–59, 55, 91–92
See application file for complete search history.

(56) References Cited

U.S. PATENT DOCUMENTS

| | | | | |
|---|---|---|---|---|
| 9,984,675 | B2 * | 5/2018 | Schuster | H04R 1/406 |
| 2004/0165735 | A1 * | 8/2004 | Opitz | H04R 1/406 381/92 |
| 2015/0317981 | A1 * | 11/2015 | Yliaho | H04S 7/30 381/26 |
| 2016/0050488 | A1 * | 2/2016 | Matheja | H04R 3/005 381/56 |
| 2016/0134966 | A1 * | 5/2016 | Fitzgerald | G06F 1/3287 381/123 |
| 2017/0272878 | A1 * | 9/2017 | Partio | H04R 3/04 |
| 2018/0270565 | A1 * | 9/2018 | Ganeshkumar | G10L 21/0205 |
| 2019/0173446 | A1 * | 6/2019 | Knode | H03G 3/32 |

* cited by examiner

*Primary Examiner* — Disler Paul
(74) *Attorney, Agent, or Firm* — Pierce Atwood LLP

(57) ABSTRACT

A system configured to detect microphone failure and optimize settings using remaining functional microphones. For example, a device may detect a defective (e.g., nonfunctional or malfunctioning) microphone when an energy level for the defective microphone is lower than a threshold value for a period of time. After detecting the defective microphone, the device may update configuration settings by reassigning microphones (e.g., selecting a functional microphone instead of the defective microphone) and/or by calculating new configuration settings accordingly (e.g., excluding a nonfunctional microphone or compensating for an attenuation or phase shift of a malfunctioning microphone). For example, the system may recalculate beamformer coefficients using the remaining microphones, which may improve a performance of the device (e.g., wakeword detection, automatic speech recognition (ASR), etc.) and result in only a marginal performance degradation relative to fully-functioning microphones.

20 Claims, 23 Drawing Sheets

FIG. 4
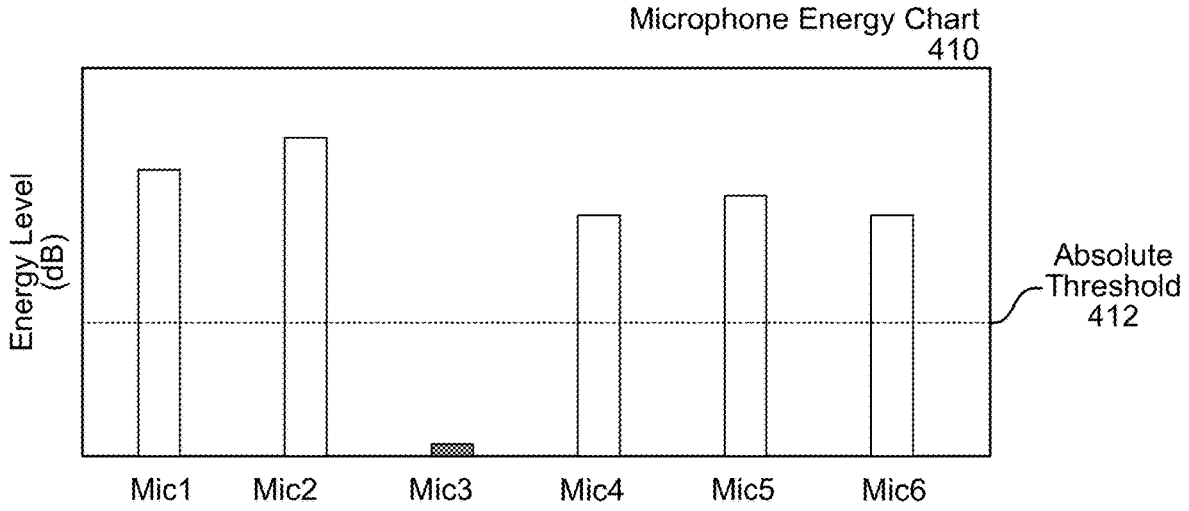
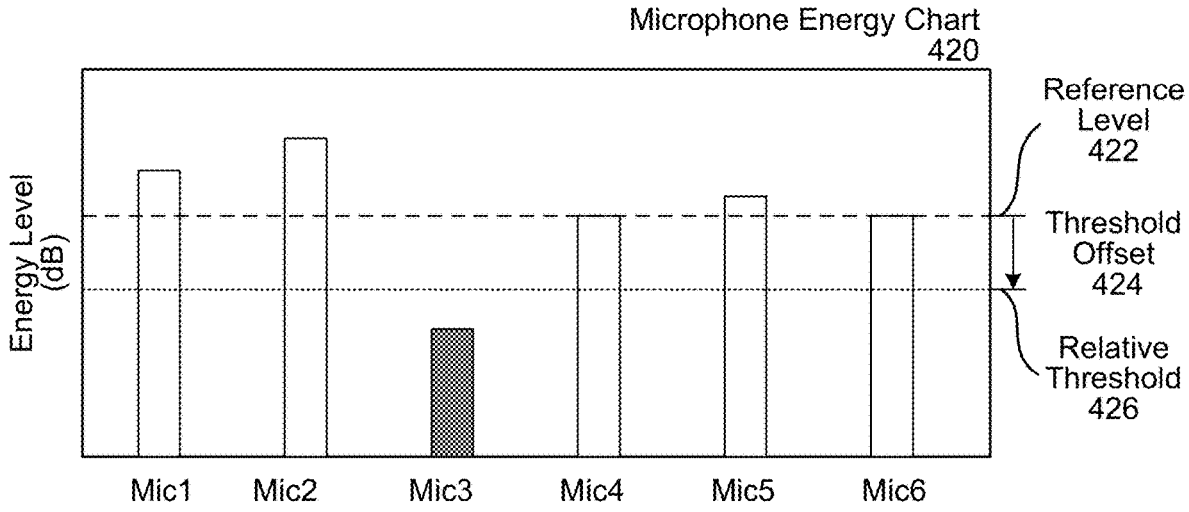

FIG. 8A

| Flag | Value |
|---|---|
| Need Update? | X |
| Mic1 | |
| Mic2 | X |
| ... | ... |
| MicN | |

Microphone Dictionary 810

Update Required Flag 812

Defective Microphone Flags 814

| Flag | Value |
|---|---|
| Need Update? | 1 |
| Mic1 | 0 |
| Mic2 | 1 |
| ... | ... |
| MicN | 0 |

Microphone Dictionary 820

Update Required Flag 822

Defective Microphone Flags 824

| Flag | Defective | Attenuation | Phase Shift |
|---|---|---|---|
| Need Update? | 1 | | |
| Mic1 | 0 | N/A | N/A |
| Mic2 | 0 | 10 dB | 60° |
| ... | ... | ... | ... |
| MicN | 1 | N/A | N/A |

Microphone Dictionary 830

Update Required Flag 832

Microphone Data 834

FIG. 8B

| Device ID | Microphone Configuration | Defective Microphones |
|---|---|---|
| 444-xxx-332 | <Config 1> | |
| 567-xjw-432 | <Config 1> | Mic3 |
| 498-jij-879 | <Config 2> | Mic6, Mic7 |
| ... | ... | ... |
| 136-sts-456 | <Config 3> | |

Device Dictionary
840

| Device ID | Device Class | Model | Version | Number of Mics | Microphone Configuration | Defective Microphones | Microphone Data |
|---|---|---|---|---|---|---|---|
| 444-xxx-332 | <Class A> | <Model 1> | 1st Gen | 8 | <Config 1> | | <Data> |
| 567-xjw-432 | <Class A> | <Model 1> | 2nd Gen | 8 | <Config 1> | Mic3 | <Data> |
| 498-jij-879 | <Class A> | <Model 2> | 1st Gen | 12 | <Config 2> | Mic6, Mic7 | <Data> |
| ... | ... | ... | ... | ... | ... | ... | ... |
| 136-sts-456 | <Class B> | <Model 3> | 3rd Gen | 3 | <Config 3> | | <Data> |

Device Dictionary
850

FIG. 8C

| Number of Functional Mics | Microphone Configuration | Settings |
|---|---|---|
| 8 | <Config 1> | <Settings 1> |
| 7 | <Config 2> | <Settings 2> |
| 6 | <Config 3> | <Settings 3> |
| 6 | <Config 4> | <Settings 4> |
| 6 | <Config 5> | <Settings 5> |
| 6 | <Config 6> | <Settings 6> |
| ... | ... | ... |
| 1 | <Config Z> | <Settings Z> |

Configuration Dictionary 860

| Number of Functional Mics | Defective Microphone(s) | Settings |
|---|---|---|
| 8 | None | <Settings 0> |
| 7 | Mic1 | <Settings 1a> |
| 7 | Mic2 | <Settings 1b> |
| ... | ... | ... |
| 7 | Mic8 | <Settings 1h> |
| 6 | Mic1/Mic2 | <Settings 2a> |
| 6 | Mic1/Mic3 | <Settings 2b> |
| ... | ... | ... |
| 6 | Mic7/Mic8 | <Settings 2n> |
| 5 | Mic1/Mic2/Mic3 | <Settings 3a> |
| ... | ... | ... |
| 1 | Mic1-Mic7 | <Settings 7> |

Configuration Dictionary 870

MICROPHONE FAILURE DETECTION AND RE-OPTIMIZATION

BACKGROUND

With the advancement of technology, the use and popularity of electronic devices has increased considerably. Electronic devices are commonly used to capture and process audio data.

BRIEF DESCRIPTION OF DRAWINGS

For a more complete understanding of the present disclosure, reference is now made to the following description taken in conjunction with the accompanying drawings.

FIG. 4 illustrates examples of detecting a defective microphone according to embodiments of the present disclosure.

FIGS. 8A-8C illustrate examples of microphone dictionaries, device dictionaries, and configuration dictionaries according to embodiments of the present disclosure.

DETAILED DESCRIPTION

Electronic devices may be used to capture and process audio data. The audio data may be used for voice commands and/or as part of a communication session, and may be generated using a single microphone or multiple microphones. In some examples, a device may capture input audio data using a single microphone in a microphone array, while in other examples the device may capture input audio data using multiple microphones in the microphone array and perform beamforming to generate directional audio data corresponding to a plurality of directions.

Performance of the device is negatively impacted when a microphone fails and is unusable by the device. If the device selects a single microphone to generate the audio data, microphone failure results in a negative user experience as the device is unable to generate audio data using the selected microphone. If the device generates the audio data using multiple microphones, microphone failure results in decreased performance as the nonfunctional microphone is relied upon during audio processing, such as beamforming, adaptive beamforming, acoustic echo cancellation, and/or the like.

To improve audio processing despite microphone failure, devices, systems and methods are disclosed that detect microphone failure and re-optimize settings using the remaining functional microphones. The system may detect a nonfunctional (e.g., dead) or malfunctioning (e.g., attenuated) microphone when an energy level for the microphone is lower than a threshold value for a period of time. For example, a first energy level of the microphone may be lower than an average energy level of functional microphones by more than a threshold (e.g., 6 dB), although the disclosure is not limited thereto. After detecting a defective microphone, the system may update configuration settings by reassigning microphones (e.g., selecting a functional microphone instead of the defective microphone) and/or by calculating new configuration settings without the defective microphone. For example, the system may recalculate beamformer coefficients using the remaining microphones, which may improve a performance of the device (e.g., wakeword detection, automatic speech recognition (ASR), etc.) and result in only a marginal performance degradation relative to fully-functioning microphones.

Figure 1:
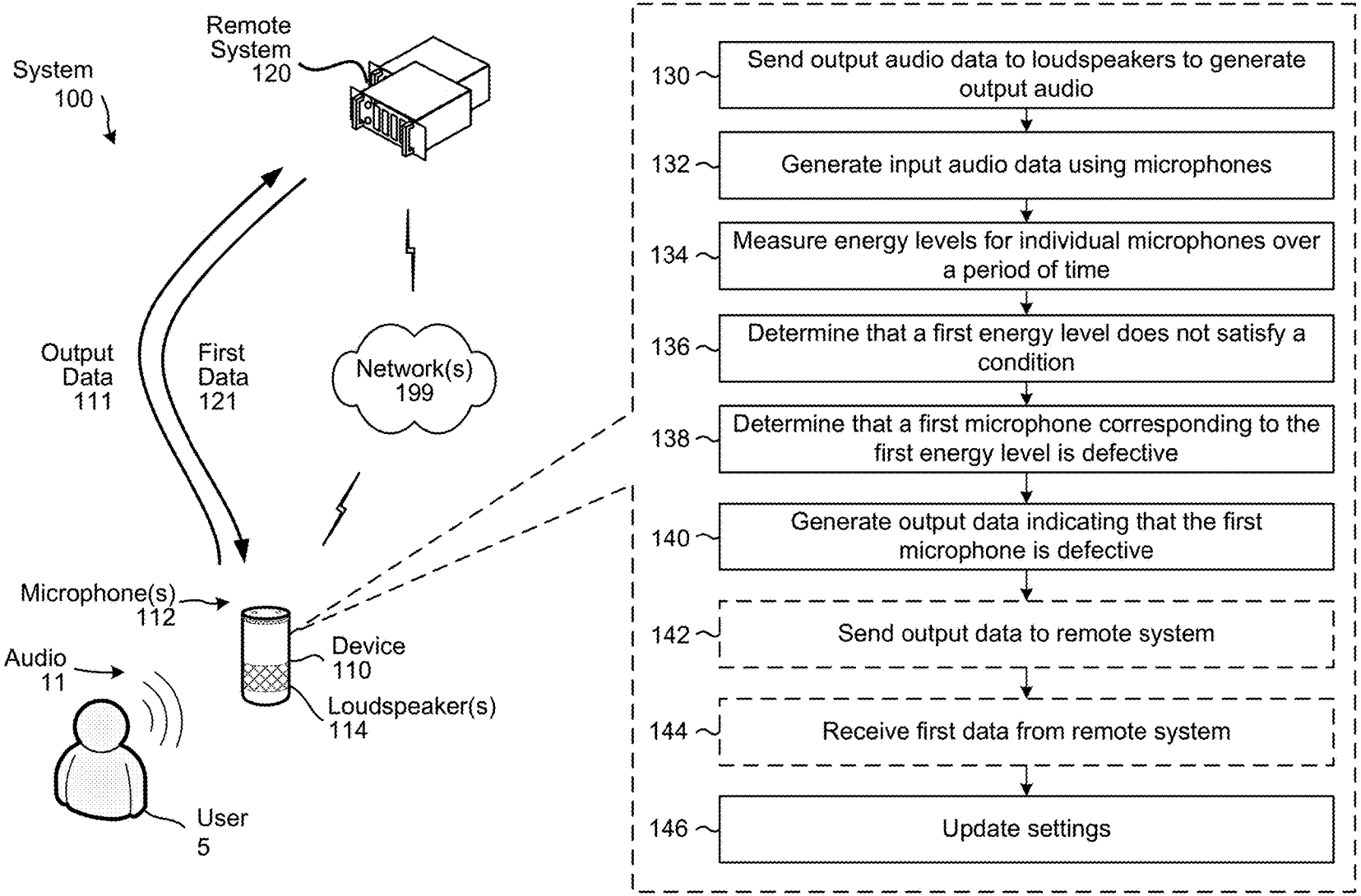
FIG. 1 illustrates a system according to embodiments of the present disclosure.

FIG. 1 illustrates a high-level conceptual block diagram of a system 100 configured to detect microphone failure and re-optimize configuration settings of a device according to embodiments of the present disclosure. Although FIG. 1, and other figures/discussion illustrate the operation of the system in a particular order, the steps described may be performed in a different order (as well as certain steps removed or added) without departing from the intent of the disclosure. A plurality of devices may communicate across one or more network(s) 199. For example, FIG. 1 illustrates an example of a device 110 (e.g., a speech-controlled device) local to a user 5 communicating with a remote system 120 via the network(s) 199.

As illustrated in FIG. 1, the device 110 may include one or more microphone(s) 112 in a microphone array and/or one or more loudspeaker(s) 114. However, the disclosure is not limited thereto and the device 110 may include additional components without departing from the disclosure. While FIG. 1 illustrates that the one or more loudspeaker(s) 114 are internal to the device 110, the disclosure is not limited thereto and the one or more loudspeaker(s) 114 may be external to the device 110 and/or connected to the device 110 wirelessly. For example, the device 110 may be connected to a wireless loudspeaker, a television, an audio system, and/or the like using a wireless and/or wired connection without departing from the disclosure.

In some examples, the remote system 120 may be configured to process voice commands (e.g., voice inputs) received from the device 110. For example, the device 110 may capture input audio 11 corresponding to a voice command from the user 5 (e.g., an utterance), may generate input audio data representing the audio 11 using the one or more microphone(s) 112, and may send the input audio data to the remote system 120 for speech processing. However, the disclosure is not limited thereto and in other examples the device 110 may send the input audio data to a remote device (not illustrated) as part of a communication session. For example, the device 110 may capture input audio 11 corresponding to the communication session, may generate input audio data representing the audio 11 using the one or more microphone(s) 112, and may send the input audio data to the remote device.

Performance of the device 110 is negatively impacted when a microphone 112 fails and is unusable by the device 110. For example, if the device 110 selects a single microphone 112 to generate input audio data, microphone failure results in a negative user experience as the device 110 is unable to generate the input audio data using the selected microphone 112 (e.g., the input audio data does not represent the audio 11). Additionally or alternatively, if the device 110 generates the input audio data using multiple microphones 112, microphone failure results in decreased performance as the nonfunctional microphone is relied upon during audio processing, such as beamforming, adaptive beamforming, acoustic echo cancellation, and/or the like.

To improve audio processing despite microphone failure, the system 100 is configured to detect microphone failure and re-optimize configuration settings using the remaining functional microphones 112. As will be described in greater detail below, the system may detect a defective (e.g., nonfunctional or malfunctioning) microphone when an energy level for the defective microphone is outside of a desired range (e.g., lower than a threshold value) for a period of time (e.g., time range). For example, a first energy level of the defective microphone may be lower than an average energy level of the functional microphones by more than a threshold (e.g., 6 dB), although the disclosure is not limited thereto. After detecting the defective microphone, the system 100 may update configuration settings by reassigning microphones (e.g., selecting a functional microphone instead of the defective microphone) and/or by calculating new configuration settings accordingly (e.g., excluding a nonfunctional microphone or compensating for an attenuation or phase shift of a malfunctioning microphone). For example, the system 100 may recalculate beamformer coefficients using the remaining microphones, which may improve a performance of the device (e.g., wakeword detection, automatic speech recognition (ASR), etc.) and result in only a marginal performance degradation relative to fully-functioning microphones.

As used herein, a defective microphone may be nonfunctional (e.g., does not capture audio and/or generates audio data with energy levels below a minimum threshold value) or malfunctioning (e.g., generates audio data with energy levels above the minimum threshold value but outside of a desired range, such as attenuated relative to a second threshold value corresponding to normal operation), whereas a functional microphone (e.g., microphone that generates audio data with energy levels within the desired range, such as above the second threshold value) may be referred to as a functional microphone, remaining microphone(s), and/or the like. In some examples, the system 100 may treat both nonfunctional microphones and malfunctioning microphones similarly and update settings to ignore both. However, the disclosure is not limited thereto and in other examples, the system 100 may update settings to ignore the nonfunctional microphones and to compensate for an attenuation and/or phase shift associated with the malfunctioning microphones without departing from the disclosure.

As illustrated in FIG. 1, the device 110 may send (130) output data to loudspeakers 114 to generate output audio, may generate (132) input audio data using microphones 112, and may measure (134) energy levels for individual microphones over a period of time (e.g., time range, such as 30 seconds).

The device 110 may determine (136) that a first energy level does not satisfy a condition (e.g., outside of a desired range, such as below a threshold value, whether an absolute threshold value or a relative threshold value), may determine (138) that a first microphone corresponding to the first energy level is defective, and may generate (140) output data 111 indicating that the first microphone is defective. In some examples, the device 110 may optionally send (142) the output data 111 to the remote system 120 and receive (144) first data 121 from the remote system 120, although the disclosure is not limited thereto. The device 110 may then update (146) settings based on the first microphone being defective. For example, the device 110 may perform microphone reassignment to deselect the first microphone and/or select a functional microphone, may calculate updated beamformer coefficients without the first microphone, and/or the like, as will be described in greater detail below.

For ease of illustration, some audio data may be referred to as a signal, such as a far-end reference signal x(t), a microphone signal z(t) (e.g., input signal), error signal m(t) or the like. However, the signals may be comprised of audio data and may be referred to as audio data (e.g., far-end reference audio data x(t), microphone audio data z(t), error audio data m(t)) without departing from the disclosure.

During a communication session, the device 110 may receive a far-end reference signal x(t) (e.g., playback audio data) from a remote device/remote server(s) (not illustrated) via the network(s) 199 and may generate output audio (e.g., playback audio) based on the far-end reference signal x(t) using the one or more loudspeaker(s) 114. Using one or more microphone(s) 112 in the microphone array, the device 110 may capture input audio as microphone signal z(t) (e.g., near-end reference audio data, input audio data, microphone audio data, etc.) and may send the microphone signal z(t) to the remote device/remote server(s) and/or the remote system 120 via the network(s) 199.

In some examples, the device 110 may send the microphone signal z(t) to the remote device as part of a Voice over Internet Protocol (VoIP) communication session. For example, the device 110 may send the microphone signal z(t) to the remote device either directly or via remote server(s) and may receive the far-end reference signal x(t) from the remote device either directly or via the remote server(s). However, the disclosure is not limited thereto and in some examples, the device 110 may send the microphone signal z(t) to the remote system 120 in order for the remote system 120 to determine a voice command. For example, during a communication session the device 110 may receive the far-end reference signal x(t) from the remote device and may generate the output audio based on the far-end reference signal x(t). However, the microphone signal z(t) may be separate from the communication session and may include a voice command directed to the remote system 120. Therefore, the device 110 may send the microphone signal z(t) to the remote system 120 and the remote system 120 may determine a voice command represented in the microphone signal z(t) and may perform an action corresponding to the voice command (e.g., execute a command, send an instruction to the device 110 and/or other devices to execute the command, etc.). In some examples, to determine the voice command the remote system 120 may perform Automatic Speech Recognition (ASR) processing, Natural Language Understanding (NLU) processing and/or command processing. The voice commands may control the device 110, audio devices (e.g., play music over loudspeaker(s) 114, capture audio using microphone(s) 112, or the like), multimedia devices (e.g., play videos using a display, such as a television, computer, tablet or the like), smart home devices (e.g., change temperature controls, turn on/off lights, lock/unlock doors, etc.) or the like.

The device 110 may operate using microphone(s) 112 comprising multiple microphones, where beamforming techniques may be used to isolate desired audio including speech. In audio systems, beamforming refers to techniques that are used to isolate audio from a particular direction in a multi-directional audio capture system. Beamforming may be particularly useful when filtering out noise from non-desired directions. Beamforming may be used for various tasks, including isolating voice commands to be executed by a speech-processing system.

One technique for beamforming involves boosting audio received from a desired direction while dampening audio received from a non-desired direction. In one example of a beamformer system, a fixed beamformer unit employs a filter-and-sum structure to boost an audio signal that originates from the desired direction (sometimes referred to as the look-direction) while largely attenuating audio signals that original from other directions. A fixed beamformer unit may effectively eliminate certain diffuse noise (e.g., undesireable audio), which is detectable in similar energies from various directions, but may be less effective in eliminating noise emanating from a single source in a particular non-desired direction. The beamformer unit may also incorporate an adaptive beamformer unit/noise canceller that can adaptively cancel noise from different directions depending on audio conditions.

In audio systems, acoustic echo cancellation (AEC) processing refers to techniques that are used to recognize when a device has recaptured sound via microphone(s) after some delay that the device previously output via loudspeaker(s). The device may perform AEC processing by subtracting a delayed version of the original audio signal (e.g., far-end reference signal x(t)) from the captured audio (e.g., microphone signal z(t)), producing a version of the captured audio that ideally eliminates the "echo" of the original audio signal, leaving only new audio information. For example, if someone were singing karaoke into a microphone while prerecorded music is output by a loudspeaker, AEC processing can be used to remove any of the recorded music from the audio captured by the microphone, allowing the singer's voice to be amplified and output without also reproducing a delayed "echo" of the original music. As another example, a media player that accepts voice commands via a microphone can use AEC processing to remove reproduced sounds corresponding to output media that are captured by the microphone, making it easier to process input voice commands.

As an alternative to generating the reference signal based on the playback audio data, Adaptive Reference Algorithm (ARA) processing may generate an adaptive reference signal based on the input audio data. To illustrate an example, the ARA processing may perform beamforming using the input audio data to generate a plurality of audio signals (e.g., beamformed audio data) corresponding to particular directions. For example, the plurality of audio signals may include a first audio signal corresponding to a first direction, a second audio signal corresponding to a second direction, a third audio signal corresponding to a third direction, and so on. The ARA processing may select the first audio signal as a target signal (e.g., the first audio signal includes a representation of speech) and the second audio signal as a reference signal (e.g., the second audio signal includes a representation of the echo and/or other acoustic noise) and may perform Adaptive Interference Cancellation (AIC) (e.g., adaptive acoustic interference cancellation) by removing the reference signal from the target signal. As the input audio data is not limited to the echo signal, the ARA processing may remove other acoustic noise represented in the input audio data in addition to removing the echo. Therefore, the ARA processing may be referred to as performing AIC, adaptive noise cancellation (ANC), AEC, and/or the like without departing from the disclosure.

As discussed in greater detail below, the device 110 may be configured to perform AIC using the ARA processing to isolate the speech in the input audio data. The device 110 may dynamically select target signal(s) and/or reference signal(s). Thus, the target signal(s) and/or the reference signal(s) may be continually changing over time based on speech, acoustic noise(s), ambient noise(s), and/or the like in an environment around the device 110. In some examples, the device 110 may select the target signal(s) based on signal quality metrics (e.g., signal-to-interference ratio (SIR) values, signal-to-noise ratio (SNR) values, average power values, etc.) differently based on current system conditions. For example, the device 110 may select target signal(s) having highest signal quality metrics during near-end single-talk conditions (e.g., to increase an amount of energy included in the target signal(s)), but select the target signal(s) having lowest signal quality metrics during far-end single-talk conditions (e.g., to decrease an amount of energy included in the target signal(s)).

Additionally or alternatively, the device 110 may select the target signal(s) by detecting speech, based on signal strength values or signal quality metrics (e.g., signal-to-noise ratio (SNR) values, average power values, etc.), and/or using other techniques or inputs, although the disclosure is not limited thereto. As an example of other techniques or inputs, the device 110 may capture video data corresponding to the input audio data, analyze the video data using computer vision processing (e.g., facial recognition, object recognition, or the like) to determine that a user is associated with a first direction, and select the target signal(s) by selecting the first audio signal corresponding to the first direction. Similarly, the adaptive beamformer may identify the reference signal(s) based on the signal strength values and/or using other inputs without departing from the disclosure. Thus, the target signal(s) and/or the reference signal(s) selected by the adaptive beamformer may vary, resulting in different filter coefficient values over time.

As discussed above, the device 110 may perform beamforming (e.g., perform a beamforming operation to generate beamformed audio data corresponding to individual directions). As used herein, beamforming (e.g., performing a beamforming operation) corresponds to generating a plurality of directional audio signals (e.g., beamformed audio data) corresponding to individual directions relative to the microphone array. For example, the beamforming operation may individually filter input audio signals generated by multiple microphones 112 in the microphone array (e.g., first audio data associated with a first microphone, second audio data associated with a second microphone, etc.) in order to separate audio data associated with different directions. Thus, first beamformed audio data corresponds to audio data associated with a first direction, second beamformed audio data corresponds to audio data associated with a second direction, and so on. In some examples, the device 110 may generate the beamformed audio data by boosting an audio signal originating from the desired direction (e.g., look direction) while attenuating audio signals that originate from other directions, although the disclosure is not limited thereto.

To perform the beamforming operation, the device 110 may apply directional calculations to the input audio signals. In some examples, the device 110 may perform the directional calculations by applying filters to the input audio signals using filter coefficients associated with specific directions. For example, the device 110 may perform a first directional calculation by applying first filter coefficients to the input audio signals to generate the first beamformed audio data and may perform a second directional calculation by applying second filter coefficients to the input audio signals to generate the second beamformed audio data.

The filter coefficients used to perform the beamforming operation may be calculated offline (e.g., preconfigured ahead of time) and stored in the device 110. For example, the device 110 may store filter coefficients associated with hundreds of different directional calculations (e.g., hundreds of specific directions) and may select the desired filter coefficients for a particular beamforming operation at runtime (e.g., during the beamforming operation). To illustrate an example, at a first time the device 110 may perform a first beamforming operation to divide input audio data into 36 different portions, with each portion associated with a specific direction (e.g., 10 degrees out of 360 degrees) relative to the device 110. At a second time, however, the device 110 may perform a second beamforming operation to divide input audio data into 6 different portions, with each portion associated with a specific direction (e.g., 60 degrees out of 360 degrees) relative to the device 110.

These directional calculations may sometimes be referred to as "beams" by one of skill in the art, with a first directional calculation (e.g., first filter coefficients) being referred to as a "first beam" corresponding to the first direction, the second directional calculation (e.g., second filter coefficients) being referred to as a "second beam" corresponding to the second direction, and so on. Thus, the device 110 stores hundreds of "beams" (e.g., directional calculations and associated filter coefficients) and uses the "beams" to perform a beamforming operation and generate a plurality of beamformed audio signals. However, "beams" may also refer to the output of the beamforming operation (e.g., plurality of beamformed audio signals). Thus, a first beam may correspond to first beamformed audio data associated with the first direction (e.g., portions of the input audio signals corresponding to the first direction), a second beam may correspond to second beamformed audio data associated with the second direction (e.g., portions of the input audio signals corresponding to the second direction), and so on. For ease of explanation, as used herein "beams" refer to the beamformed audio signals that are generated by the beamforming operation. Therefore, a first beam corresponds to first audio data associated with a first direction, whereas a first directional calculation corresponds to the first filter coefficients used to generate the first beam.

Prior to sending the microphone signal z(t) to the remote device/remote system 120, the device 110 may perform acoustic echo cancellation (AEC), adaptive interference cancellation (AIC), residual echo suppression (RES), and/or other audio processing to isolate local speech captured by the microphone(s) 112 and/or to suppress unwanted audio data (e.g., echoes and/or noise). For example, the device 110 may receive the far-end reference signal x(t) (e.g., playback audio data) and may generate playback audio (e.g., echo signal y(t)) using the loudspeaker(s) 114. The far-end reference signal x(t) may be referred to as a far-end reference signal (e.g., far-end reference audio data), a playback signal (e.g., playback audio data) or the like. The one or more microphone(s) 112 in the microphone array may capture a microphone signal z(t) (e.g., microphone audio data, near-end reference signal, input audio data, etc.), which may include the echo signal y(t) along with near-end speech s(t) from the user 10 and noise n(t).

To isolate the local speech (e.g., near-end speech s(t) from the user 10), the device 110 may include an AIC component that selects target signal(s) and reference signal(s) from the beamformed audio data and generates an error signal m(t) by removing the reference signal(s) from the target signal(s). As the AIC component does not have access to the echo signal y(t) itself, the reference signal(s) are selected as an approximation of the echo signal y(t). Thus, when the AIC component removes the reference signal(s) from the target signal(s), the AIC component is removing at least a portion of the echo signal y(t). In addition, the reference signal(s) may include the noise n(t) and other acoustic interference. Therefore, the output (e.g., error signal m(t)) of the AIC component may include the near-end speech s(t) along with portions of the echo signal y(t) and/or the noise n(t) (e.g., difference between the reference signal(s) and the actual echo signal y(t) and noise n(t)).

An audio signal is a representation of sound and an electronic representation of an audio signal may be referred to as audio data, which may be analog and/or digital without departing from the disclosure. For ease of illustration, the disclosure may refer to either audio data (e.g., far-end reference audio data or playback audio data, microphone audio data, near-end reference data or input audio data, etc.) or audio signals (e.g., playback signal, far-end reference signal, microphone signal, near-end reference signal, etc.) without departing from the disclosure. Additionally or alternatively, portions of a signal may be referenced as a portion of the signal or as a separate signal and/or portions of audio data may be referenced as a portion of the audio data or as separate audio data. For example, a first audio signal may correspond to a first period of time (e.g., time range, such as 30 seconds) and a portion of the first audio signal corresponding to a second period of time (e.g., 1 second) may be referred to as a first portion of the first audio signal or as a second audio signal without departing from the disclosure. Similarly, first audio data may correspond to the first period of time (e.g., 30 seconds) and a portion of the first audio data corresponding to the second period of time (e.g., 1 second) may be referred to as a first portion of the first audio data or second audio data without departing from the disclosure. Audio signals and audio data may be used interchangeably, as well; a first audio signal may correspond to the first period of time (e.g., 30 seconds) and a portion of the first audio signal corresponding to a second period of time (e.g., 1 second) may be referred to as first audio data without departing from the disclosure.

As used herein, audio signals or audio data (e.g., far-end reference audio data, near-end reference audio data, microphone audio data, or the like) may correspond to a specific range of frequency bands. For example, far-end reference audio data and/or near-end reference audio data may correspond to a human hearing range (e.g., 20 Hz-20 kHz), although the disclosure is not limited thereto.

Far-end reference audio data (e.g., far-end reference signal x(t)) corresponds to audio data that will be output by the loudspeaker(s) 114 to generate playback audio (e.g., echo signal y(t)). For example, the device 110 may stream music or output speech associated with a communication session (e.g., audio or video telecommunication). In some examples, the far-end reference audio data may be referred to as playback audio data, loudspeaker audio data, and/or the like without departing from the disclosure. For ease of illustration, the following description will refer to the playback audio data as far-end reference audio data. As noted above, the far-end reference audio data may be referred to as far-end reference signal(s) x(t) without departing from the disclosure.

Microphone audio data corresponds to audio data that is captured by the microphone(s) 112 prior to the device 110 performing audio processing such as AIC processing. The microphone audio data may include local speech s(t) (e.g., an utterance, such as near-end speech generated by the user 10), an "echo" signal y(t) (e.g., portion of the playback audio captured by the microphone(s) 112), acoustic noise n(t) (e.g., ambient noise in an environment around the device 110), and/or the like. As the microphone audio data is captured by the microphone(s) 112 and captures audio input to the device 110, the microphone audio data may be referred to as input audio data, near-end audio data, and/or the like without departing from the disclosure. For ease of illustration, the following description will refer to microphone audio data and near-end reference audio data interchangeably. As noted above, the near-end reference audio data/microphone audio data may be referred to as a near-end reference signal or microphone signal z(t) without departing from the disclosure.

Output audio data corresponds to audio data after the device 110 performs audio processing (e.g., AIC processing, ANC processing, AEC processing, and/or the like) to isolate the local speech s(t). For example, the output audio data r(t) corresponds to the microphone audio data z(t) after subtracting the reference signal(s) (e.g., using an adaptive interference cancellation (AIC) component), optionally performing residual echo suppression (RES) (e.g., using a RES component), and/or other audio processing known to one of skill in the art. As noted above, the output audio data may be referred to as output audio signal(s) without departing from the disclosure, and one of skill in the art will recognize that the output audio data may also be referred to as an error audio data m(t), error signal m(t) and/or the like.

Further details of the device operation are described below following a discussion of directionality in reference to FIGS. 2-3C.

Figure 2:
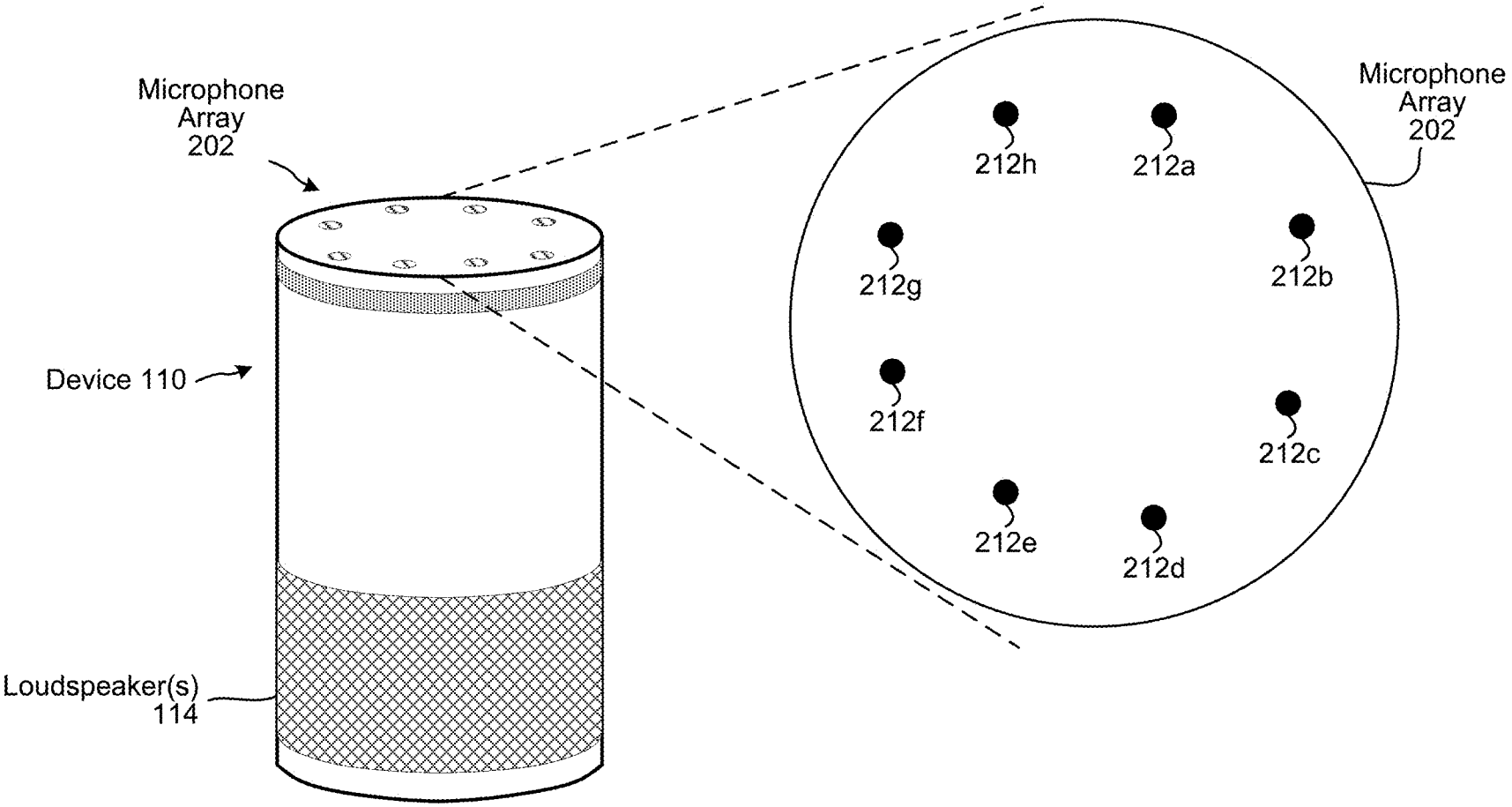
FIG. 2 illustrates a microphone array according to embodiments of the present disclosure.

As illustrated in FIG. 2, a device 110 may include, among other components, a microphone array 202 including a plurality of microphone(s) 212, one or more loudspeaker(s) 114, a beamformer unit (as discussed below), or other components. The microphone array 202 may include a number of different individual microphones 212. In the example configuration of FIG. 2, the microphone array includes eight (8) microphones, 212*a*-212*h*. The individual microphones 212 may capture sound and pass the resulting audio signal created by the sound to a downstream component, such as an analysis filterbank. Each individual piece of audio data captured by a microphone may be in a time domain. To isolate audio from a particular direction, the device may compare the audio data (or audio signals related to the audio data, such as audio signals in a sub-band domain) to determine a time difference of detection of a particular segment of audio data. If the audio data for a first microphone includes the segment of audio data earlier in time than the audio data for a second microphone, then the device may determine that the source of the audio that resulted in the segment of audio data may be located closer to the first microphone than to the second microphone (which resulted in the audio being detected by the first microphone before being detected by the second microphone).

Figure 3A:
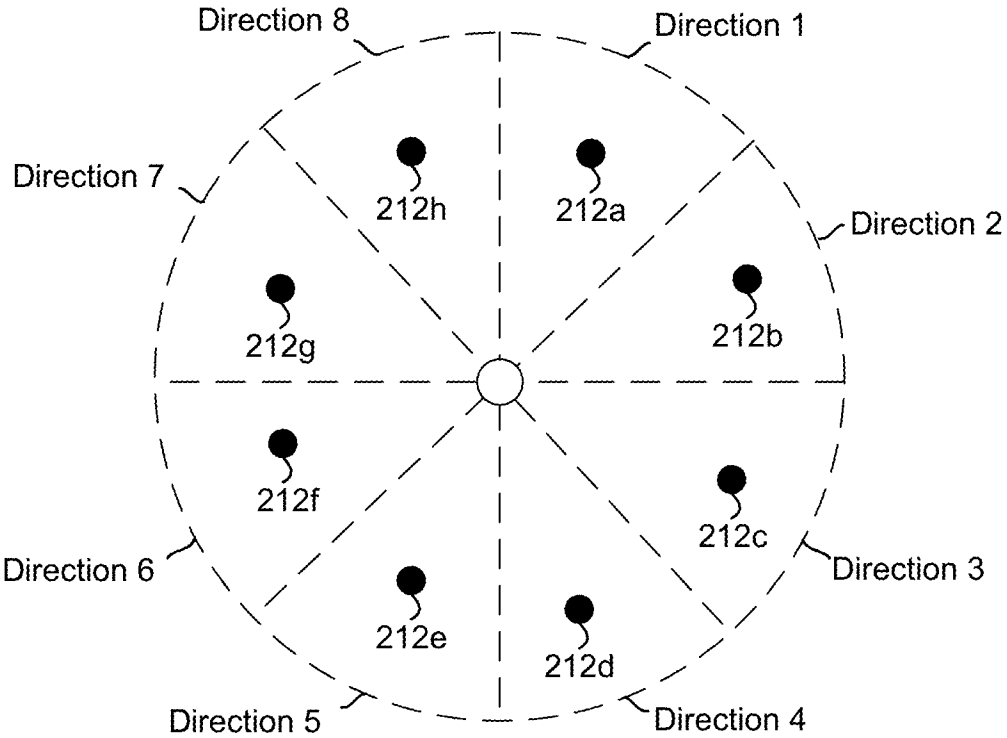
FIG. 3A illustrates associating directions with microphones of a microphone array according to embodiments of the present disclosure.

Using such direction isolation techniques, a device 110 may isolate directionality of audio sources. As shown in FIG. 3A, a particular direction may be associated with a particular microphone 212 of a microphone array, where the azimuth angles for the plane of the microphone array may be divided into bins (e.g., 0-45 degrees, 46-90 degrees, and so forth) where each bin direction is associated with a microphone in the microphone array. For example, direction 1 is associated with microphone 212*a*, direction 2 is associated with microphone 212*b*, and so on. Alternatively, particular directions and/or beams may not necessarily be associated with a specific microphone without departing from the present disclosure. For example, the device 110 may include any number of microphones and/or may isolate any number of directions without departing from the disclosure.

To isolate audio from a particular direction the device may apply a variety of audio filters to the output of the microphones where certain audio is boosted while other audio is dampened, to create isolated audio data corresponding to a particular direction, which may be referred to as a beam. While in some examples the number of beams may correspond to the number of microphones, the disclosure is not limited thereto and the number of beams may vary from the number of microphones without departing from the disclosure. For example, a two-microphone array may be processed to obtain more than two beams, using filters and beamforming techniques to isolate audio from more than two directions. Thus, the number of microphones may be more than, less than, or the same as the number of beams. The beamformer unit of the device may have a fixed beamformer (FBF) unit and/or an adaptive beamformer (ABF) unit processing pipeline for each beam without departing from the disclosure.

The device 110 may use various techniques to determine the beam corresponding to the look-direction. For example, if audio is first detected by a particular microphone, the device 110 may determine that the source of the audio is associated with the direction of the microphone in the array. Other techniques may include determining which microphone detected the audio with a largest amplitude (which in turn may result in a highest strength of the audio signal portion corresponding to the audio). Other techniques (either in the time domain or in the sub-band domain) may also be used such as calculating a signal-to-noise ratio (SNR) for each beam, performing voice activity detection (VAD) on each beam, or the like.

Figure 3B:
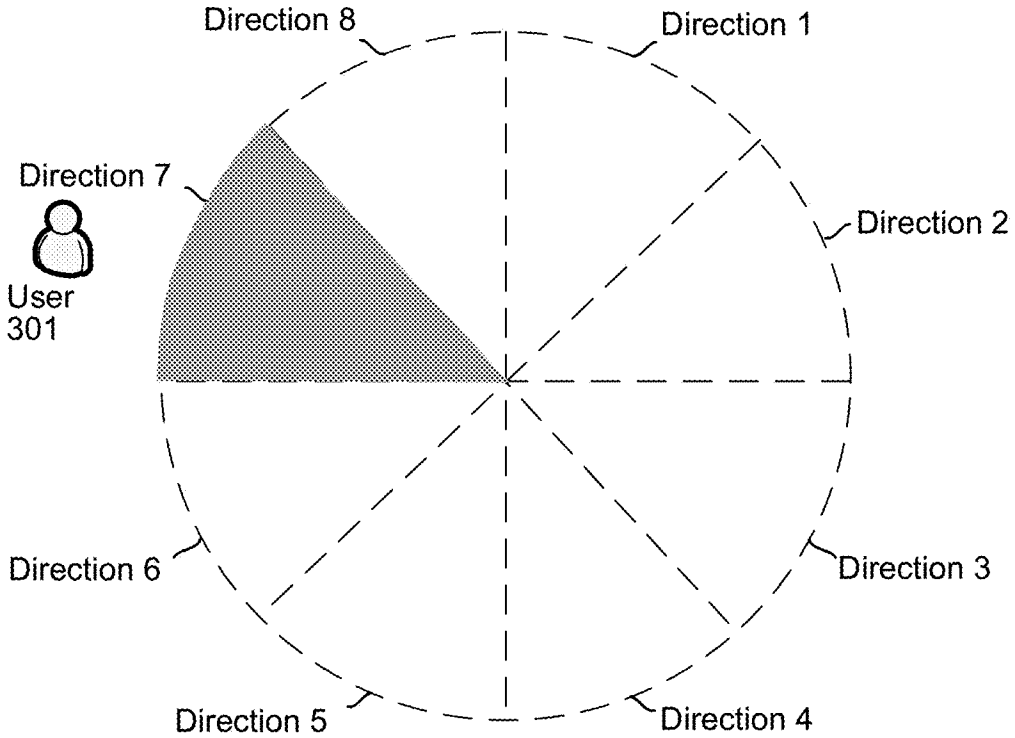
FIGS. 3B and 3C illustrate isolating audio from a direction to focus on a desired audio source according to embodiments of the present disclosure.
Figure 3C:
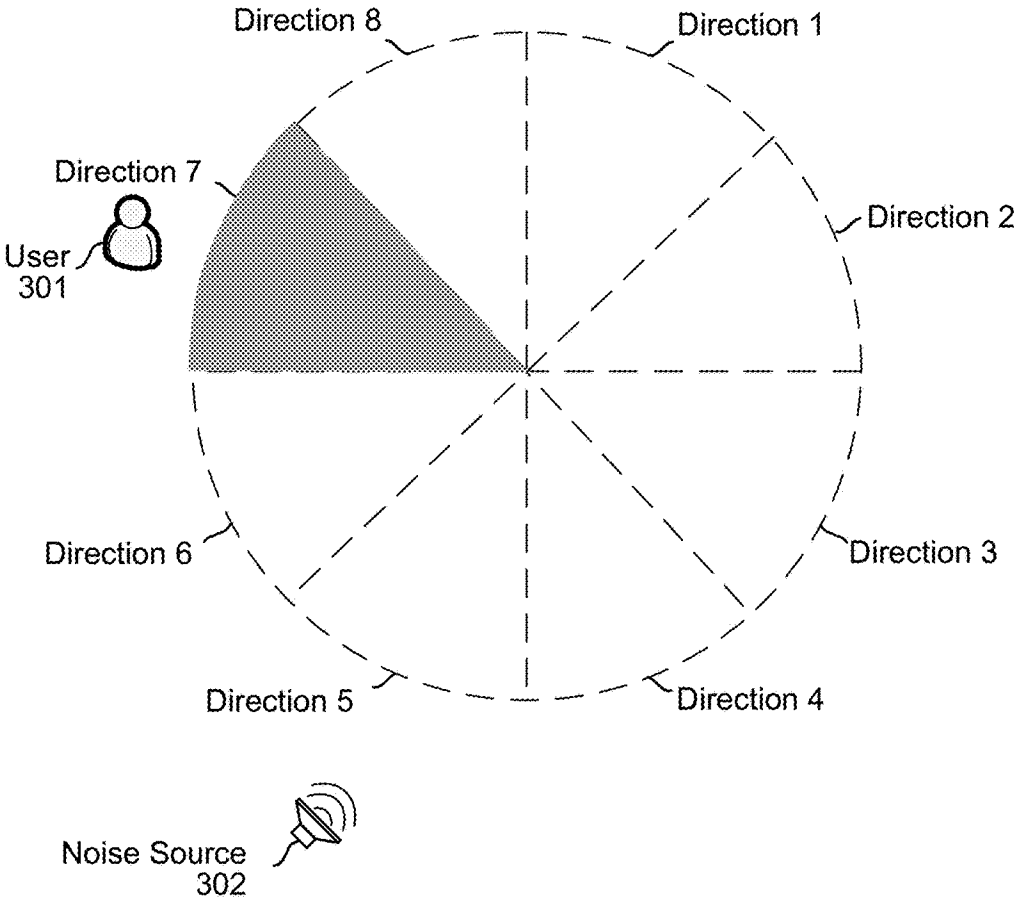

To illustrate an example, if audio data corresponding to a user's speech is first detected and/or is most strongly detected by microphone 212*g*, the device 110 may determine that a user 301 is located at a location in direction 7. Using a FBF unit or other such component, the device 110 may isolate audio data coming from direction 7 using techniques known to the art and/or explained herein. Thus, as shown in FIG. 3B, the device 110 may boost audio data coming from direction 7, thus increasing the amplitude of audio data corresponding to speech from the user 301 relative to other audio data captured from other directions. In this manner, noise from diffuse sources that is coming from all the other directions will be dampened relative to the desired audio (e.g., speech from user 301) coming from direction 7.

One drawback to the FBF unit approach is that it may not function as well in dampening/canceling noise from a noise source that is not diffuse, but rather coherent and focused from a particular direction. For example, as shown in FIG. 3C, a noise source 302 may be coming from direction 5 but may be sufficiently loud that noise canceling/beamforming techniques using an FBF unit alone may not be sufficient to remove all the undesired audio coming from the noise source 302, thus resulting in an ultimate output audio signal determined by the device 110 that includes some representation of the desired audio resulting from user 301 but also some representation of the undesired audio resulting from noise source 302.

Conventional systems isolate the speech in the input audio data by performing acoustic echo cancellation (AEC) to remove the echo signal from the input audio data. For example, conventional acoustic echo cancellation may generate a reference signal based on the playback audio data and may remove the reference signal from the input audio data to generate output audio data representing the speech.

As an alternative to generating the reference signal based on the playback audio data, Adaptive Reference Algorithm (ARA) processing may generate an adaptive reference signal based on the input audio data. For example, the device 110 may perform beamforming using the input audio data to generate a plurality of audio signals (e.g., beamformed audio data) corresponding to particular directions (e.g., a first audio signal corresponding to a first direction, a second audio signal corresponding to a second direction, etc.). After beamforming, the device 110 may optionally perform adaptive interference cancellation using the ARA processing on the beamformed audio data. For example, after generating the plurality of audio signals, the device 110 may determine one or more target signal(s), determine one or more reference signal(s), and generate output audio data by subtracting at least a portion of the reference signal(s) from the target signal(s). For example, the ARA processing may select the first audio signal as a target signal (e.g., the first audio signal includes a representation of speech) and the second audio signal as a reference signal (e.g., the second audio signal includes a representation of the echo and/or other acoustic noise), and may perform AIC by removing (e.g., subtracting) the reference signal from the target signal.

To improve noise cancellation, the AIC component may amplify audio signals from two or more directions other than the look direction (e.g., target signal). These audio signals represent noise signals so the resulting amplified audio signals may be referred to as noise reference signals. The device 110 may then weight the noise reference signals, for example using filters, and combine the weighted noise reference signals into a combined (weighted) noise reference signal. Alternatively the device 110 may not weight the noise reference signals and may simply combine them into the combined noise reference signal without weighting. The device 110 may then subtract the combined noise reference signal from the target signal to obtain a difference (e.g., noise-cancelled audio data). The device 110 may then output that difference, which represents the desired output audio signal with the noise removed. The diffuse noise is removed by the FBF unit when determining the target signal and the directional noise is removed when the combined noise reference signal is subtracted.

The device 110 may dynamically select target signal(s) and/or reference signal(s). Thus, the target signal(s) and/or the reference signal(s) may be continually changing over time based on speech, acoustic noise(s), ambient noise(s), and/or the like in an environment around the device 110. For example, the adaptive beamformer may select the target signal(s) by detecting speech, based on signal strength values (e.g., signal-to-noise ratio (SNR) values, average power values, etc.), and/or using other techniques or inputs, although the disclosure is not limited thereto. As an example of other techniques or inputs, the device 110 may capture video data corresponding to the input audio data, analyze the video data using computer vision processing (e.g., facial recognition, object recognition, or the like) to determine that a user is associated with a first direction, and select the target signal(s) by selecting the first audio signal corresponding to the first direction. Similarly, the device 110 may identify the reference signal(s) based on the signal strength values and/or using other inputs without departing from the disclosure. Thus, the target signal(s) and/or the reference signal(s) selected by the device 110 may vary, resulting in different filter coefficient values over time.

As discussed above, microphone failure negatively impacts a performance of the device 110. To improve performance of the device 110, the device 110 may detect defective microphones, such as nonfunctional (e.g., dead) and/or malfunctioning (e.g., attenuated) microphone(s), and re-optimize configuration settings of the device 110 accordingly. The device 110 may detect defective microphone(s) by measuring energy levels for each of the microphones 112 in the microphone array for a period of time (e.g., 30 seconds). For example, the device 110 may detect a defective microphone when an energy level for the defective microphone is lower than an absolute threshold value. Additionally or alternatively, the device 110 may detect a defective microphone when an energy level for the defective microphone is lower than a reference energy level (e.g., lowest energy level for remaining microphones 112, average energy level for remaining microphones 112, and/or the like) by more than a threshold offset (e.g., 6 dB).

FIG. 4 illustrates examples of detecting a defective microphone according to embodiments of the present disclosure. The device 110 may detect defective microphone(s) 112 by measuring energy levels for each of the microphones 112 in the microphone array for a period of time (e.g., 30 seconds) and comparing the energy levels to desired range and/or a threshold value. As illustrated in FIG. 4, the threshold value may correspond to an absolute threshold value and/or a relative threshold value without departing from the disclosure.

Microphone energy chart 410 illustrates an example of detecting the defective microphone using an absolute threshold value 412. For example, the device 110 may detect a defective microphone when an energy level for a microphone 112 is lower than the absolute threshold value 412. Thus, any microphones 112 associated with an energy level above the absolute threshold value 412 are considered functional, and any microphones 112 associated with an energy level below the absolute threshold value 412 are considered defective, regardless of a magnitude of the output audio being captured. The absolute threshold value 412 may be selected to distinguish low energy levels (e.g., near zero) from active energy levels of functional microphones 112.

As illustrated in FIG. 4, the microphone energy chart 410 illustrates that a first microphone (Mic1), a second microphone (Mic2), a fourth microphone (Mic4), a fifth microphone (Mic5), and a sixth microphone (Mic6) have energy levels that are above the absolute threshold value 412, whereas a third microphone (Mic3) has an energy level that is below the absolute threshold value 412. Thus, the device 110 would determine that the third microphone (Mic3) is defective while the remaining microphones 112 are all functional.

In contrast, microphone energy chart 420 illustrates an example of detecting the defective microphone using a relative threshold value 426. For example, the device 110 may detect a defective microphone when an energy level for a microphone 112 is lower than the relative threshold value 426. Thus, any microphones 112 associated with an energy level above the relative threshold value 426 are considered functional, and any microphones 112 associated with an energy level below the relative threshold value 426 are considered defective. Thus, the relative threshold value 426 takes into account a magnitude of the output audio being captured, as the relative threshold value 426 is determined based on energy levels of functional microphone(s) 112. For example, the relative threshold value 426 may be lower when a magnitude of the output audio is lower and may be higher when a magnitude of the output audio is higher.

The relative threshold value 426 may be determined by determining a reference level 422 and subtracting a threshold offset 424 from the reference level 422. The device 110 may determine the reference level 422 based on energy levels associated with a majority of the microphones 112. For example, the reference level 422 may be determined based on a second lowest energy value, a lowest energy value for a group of microphones 112, an average energy level for a group of microphones 112, and/or the like without departing from the disclosure, although the disclosure is not limited thereto.

As illustrated in FIG. 4, the microphone energy chart 420 illustrates that a first microphone (Mic1), a second microphone (Mic2), a fourth microphone (Mic4), a fifth microphone (Mic5), and a sixth microphone (Mic6) have energy levels that are relatively high and similar to each other, whereas a third microphone (Mic3) has an energy level that is relatively low. Thus, the device 110 may determine the reference level 422 based on the high energy levels associated with the group of microphones (e.g., microphones 1-2 and 4-6). As illustrated in FIG. 4, the device 110 determined the reference level 422 based on a lowest energy level of the group of microphones (e.g., energy level of microphones 4 and 6), although the disclosure is not limited thereto. The device 110 may determine the relative threshold value 426 by subtracting a threshold offset 424 (e.g., 6 dB, although this offset may vary) from the reference level 422.

Using the relative threshold value 426, the device 110 may determine that a third energy level of the third microphone (Mic3) is below the relative threshold value 426 and therefore the third microphone (Mic3) is defective, even though the third energy level may be above the absolute threshold value 412. Thus, even though the third microphone generates some audio data, the device 110 may improve performance by determining that the third microphone has a lower energy level than the remaining microphones and re-optimizing configuration settings to exclude the third microphone.

Figure 5A:
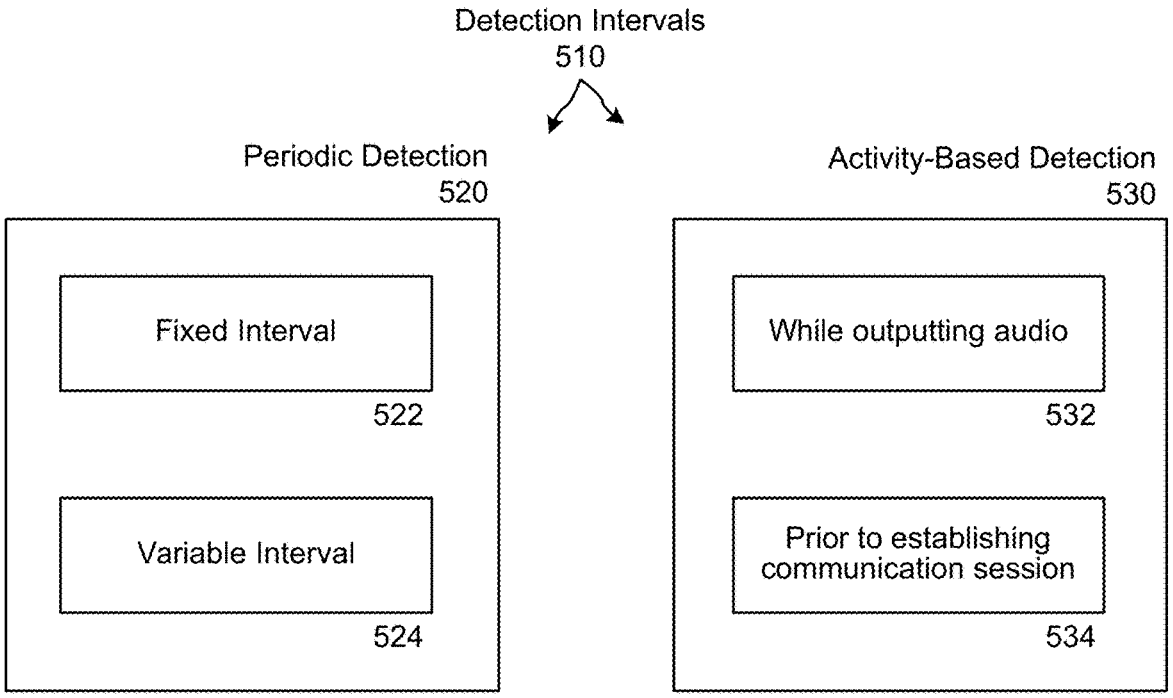
FIGS. 5A-5B illustrate examples of parameters for microphone failure detection according to embodiments of the present disclosure.
Figure 5B:
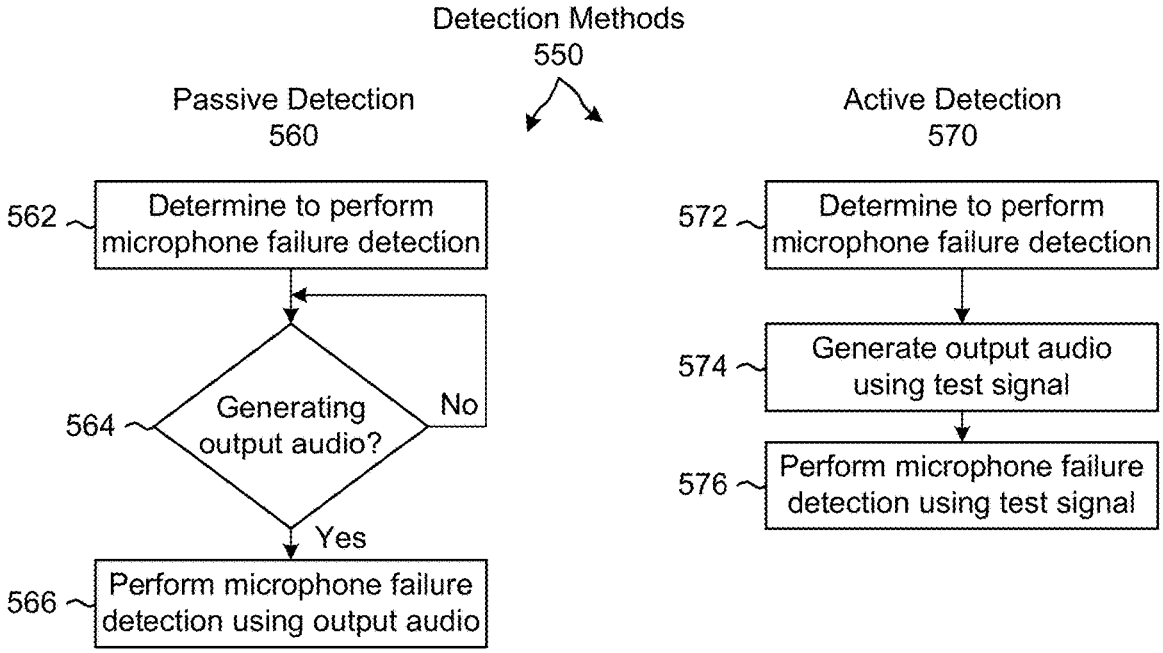

FIGS. 5A-5B illustrate examples of parameters for microphone failure detection according to embodiments of the present disclosure. As illustrated in FIG. 5A, the device 110 may perform microphone failure detection using different detection intervals 510. For example, the device 110 may perform periodic detection 520, activity-based detection 530, and/or the like without departing from the disclosure.

Periodic detection 520 corresponds to performing microphone failure detection periodically based on a period of time (e.g., every day, every week, etc.). In some examples, the periodic detection 520 may be performed using a fixed interval 522 (e.g., fixed period of time), such that the device 110 performs microphone failure detection consistently at the same time. For example, the fixed interval 522 may result in the device 110 performing microphone failure detection every day at a scheduled time, every week at a scheduled time, and/or the like.

Additionally or alternatively, the periodic detection 520 may be performed using a variable interval 524 (e.g., variable period of time), such that the device 110 performs microphone failure detection at approximately the same time depending on activity of the device 110. For example, the variable interval 524 may correspond to a desired period of time (e.g., daily, weekly, etc.), but the device 110 may delay performing microphone failure detection until the device 110 generates output audio using the loudspeaker(s) 114. Thus, the device 110 may perform microphone failure detection every day or week at variable times depending on when output audio is being generated by the device.

In contrast, activity-based detection 530 corresponds to performing microphone failure detection based on an activity being performed, without regard to a duration of time or frequency of the activity. For example, the device 110 may perform microphone failure detection while outputting audio 532, which corresponds to performing microphone failure detection as a background process every time the device 110 generates output audio. Additionally or alternatively, the device 110 may perform microphone failure detection prior to establishing a communication session 534, which corresponds to performing microphone failure detection as an initialization step before establishing the communication session (e.g., using VoIP or the like).

Performing periodic detection 520 is beneficial as the device 110 regularly verifies whether the microphones 112 are functional and optimizes configuration settings based on the functional microphones 112, regardless of the activities performed by the device 110. In contrast, performing activity-based detection 530 is beneficial as the device 110 verifies whether the microphones 112 are functional prior to and/or while performing an activity, ensuring that a performance of the device 110 is optimized for the activity and avoiding a negative user experience caused by a defective microphone. The device 110 may perform periodic detection 520 and activity-based detection 530, although the disclosure is not limited thereto.

As illustrated in FIG. 5B, the device 110 may perform microphone failure detection using different detection methods 550. For example, the device 110 may perform passive detection 560, active detection 570, and/or the like without departing from the disclosure.

Passive detection 560 corresponds to performing microphone failure detection based on output audio generated by other applications or tasks running on the device 110. For example, the device 110 may be generating output audio corresponding to music and may perform microphone failure detection using the output audio. Thus, performing the microphone failure detection may depend on other activities (e.g., when output audio is being generated), but may not be detected by the user 5 as the music is being used as a test signal with which to measure energy levels for the microphones 112.

As illustrated in FIG. 5B, the device 110 may determine (562) to perform microphone failure detection and may determine (564) whether the device 110 is generating output audio. If the device 110 is not generating output audio, the device 110 may wait until the device 110 determines that output audio is being generated. Once the device 110 determines that output audio is being generated, the device 110 may perform (566) microphone failure detection using the output audio.

While FIG. 5B illustrates passive detection 560 being performed only when the device 110 is generating output audio, the disclosure is not limited thereto. In some examples, the device 110 may perform microphone failure detection based on external noise sources without departing from the disclosure. For example, if the device 110 is not generating output audio but the microphones 112 are generating input audio data having positive energy levels, the device 110 may measure the energy levels and perform microphone failure detection.

Active detection 570 corresponds to generating output audio in order to perform microphone failure detection. For example, the device 110 may generate output audio corresponding to a test signal and may perform microphone failure detection using the test signal. Thus, the device 110 may perform microphone failure detection regardless of whether the device 110 is currently active and/or already generating output audio.

As illustrated in FIG. 5B, the device 110 may determine (572) to perform microphone failure detection, may generate (574) output audio using a test signal, and may perform (576) microphone failure detection using the test signal.

Figure 6A:
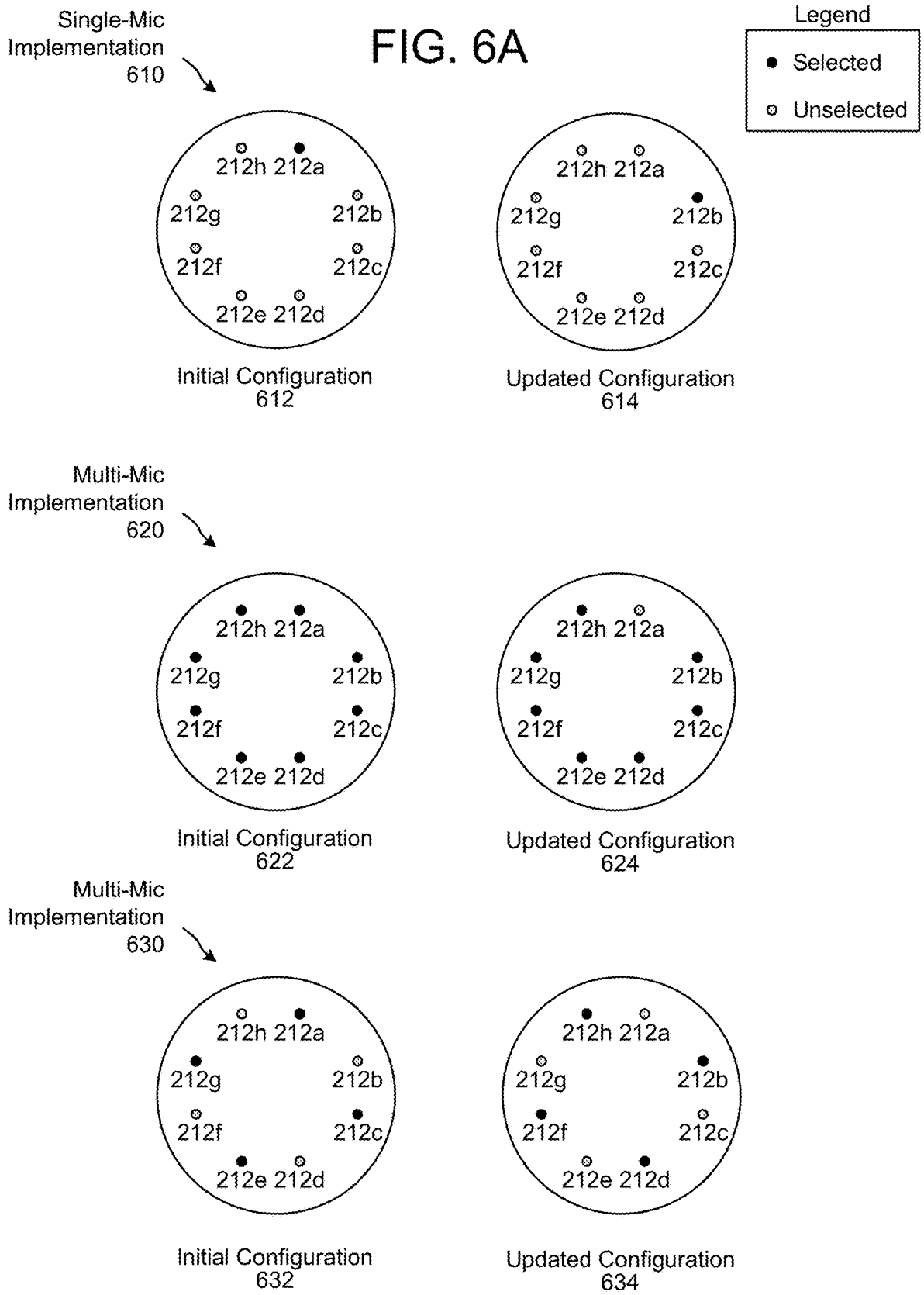
FIGS. 6A-6B illustrate examples of updating settings according to embodiments of the present disclosure.
Figure 6B:
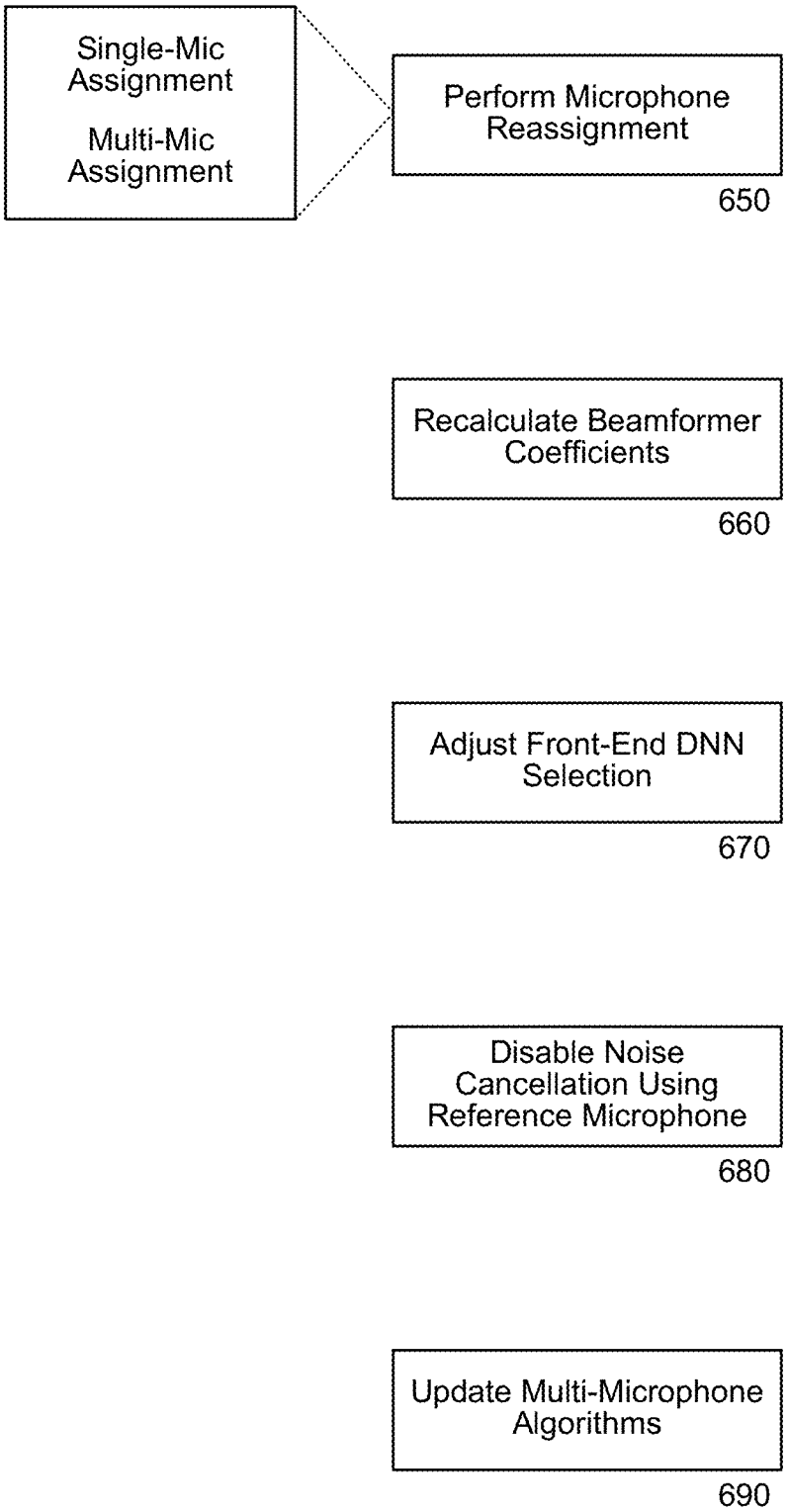

FIGS. 6A-6B illustrate examples of updating settings according to embodiments of the present disclosure. As illustrated in FIG. 6A, the device 110 may update configuration settings of the device 110 by changing a microphone selection to exclude a defective microphone. In some examples, the device 110 may perform microphone reassignment by changing which microphone(s) 112 are assigned to a particular task or application. In other examples, the device 110 may generate new configuration settings based on the microphone(s) 112 selected in an updated configuration.

FIG. 6A illustrates a single-microphone implementation 610, in which the device 110 replaces an initial configuration 612 with an updated configuration 614. For example, the initial configuration 612 indicates that a first microphone 212*a* is selected, whereas the updated configuration 614 indicates that a second microphone 212*b* is selected instead. Thus, the device 110 may determine that the first microphone 212*a* is defective and select a functional microphone (e.g., second microphone 212*b*) in the updated configuration 614 instead.

Additionally or alternatively, FIG. 6A illustrates a first multi-microphone implementation 620, in which the device 110 replaces an initial configuration 622 with an updated configuration 624. For example, the initial configuration 622 indicates that eight microphones 212*a*-212*h* are selected, whereas the updated configuration 624 indicates that only seven microphones 212*b*-212*h* are selected instead. Thus, the device 110 may determine that the first microphone 212*a* is defective and deselect the first microphone 212*a* in the updated configuration 624.

While the first multi-microphone implementation 620 indicates that all functional microphones 112 are selected, the disclosure is not limited thereto. For example, FIG. 6A illustrates a second multi-microphone implementation 630, in which the device 110 replaces an initial configuration 632 with an updated configuration 634. In this example, the initial configuration 632 indicates that a first group of microphones (e.g., microphones 212*a*/212*c*/212*e*/212*g*) are selected, whereas the updated configuration 634 indicates that a second group of microphones (e.g., microphones 212*b*/212*d*/212*f*/212*h*) are selected instead. Thus, the device 110 may determine that the first microphone 212*a* is defective and select a completely different group of microphones to compensate for the defective microphone.

As mentioned above, the microphone configurations illustrated in FIG. 6A may correspond to microphone assignments, indicating that the selected microphones 112 are used for a particular task or application running on the device 110. For example, during a communication session (e.g., using VoIP), the device 110 may generate audio data using the selected microphones 112 indicated by the updated configurations 614/624/634. However, the disclosure is not limited thereto, and the microphone configurations may instead correspond to the microphones 112 used to generate the configuration settings. For example, the device 110 and/or the remote system 120 may calculate beamformer coefficients or other parameters based on the selected microphones indicated in the updated configurations 614/624/634 without departing from the disclosure.

In some examples, the device 110 may select one or more first microphones as a target signal and select one or more second microphones as a reference signal. For example, the device 110 may arbitrarily select a single microphone as the reference signal and use the remaining microphones to generate the target signal. Thus, the device 110 may perform echo cancellation by removing the reference signal from the target signal. During microphone reassignment, the device 110 may update the one or more first microphones and/or the one or more second microphones to remove defective microphones and/or adjust the microphone assignment accordingly. For example, if the single reference microphone is defective, the device 110 may select one of the functional microphones as a new reference microphone and recalculate settings (e.g., beamformer coefficient values) for the remaining microphones.

FIG. 6B illustrates examples of other parameters and/or adjustments made when updating the configuration settings of the device 110. For example, the system 100 may perform (650) microphone reassignment, including single-microphone assignment and/or multi-microphone assignment, as discussed above with regard to FIG. 6A. The system 100 may also recalculate (660) beamformer coefficients, adjust (670) front-end deep neural network (DNN) selection, disable (680) noise cancellation using a reference microphone, update (690) multi-microphone algorithms, and/or the like.

Adjusting front-end DNN selection (670) may correspond to selecting a different front-end DNN to process input audio data based on a number of input channels received from functional microphones. For example, each front-end DNN may be configured to process input audio data from a fixed number of microphones, such that input audio data associated with four microphones is sent to a four-input DNN, input audio data associated with three microphones is sent to a three-input DNN, and so on. Therefore, if one or more microphones is determined to be defective, the device 110 may select a different front-end DNN to process the input audio data based on the number of functional microphones remaining.

Disabling noise cancellation using a reference microphone (680) may correspond to performing noise cancellation using a dedicated reference microphone. For example, the reference microphone may be positioned in proximity to a noise source and/or directed at a noise source and the device 110 may perform a first stage of noise cancellation using audio data generated by the reference microphone. If the device 110 determines that the reference microphone is defective, the device 110 may disable the first stage of noise cancellation.

Updating multi-microphone algorithms (690) may correspond to particular algorithms that are performed using audio data generated by multiple microphones 112 of the device 110. For example, an algorithm may reduce wind noise or the like based on audio data generated by several microphones 112. If the device 110 determines that one of the microphones is defective, the device 110 may update the algorithm to deselect the defective microphone(s).

Figure 7:
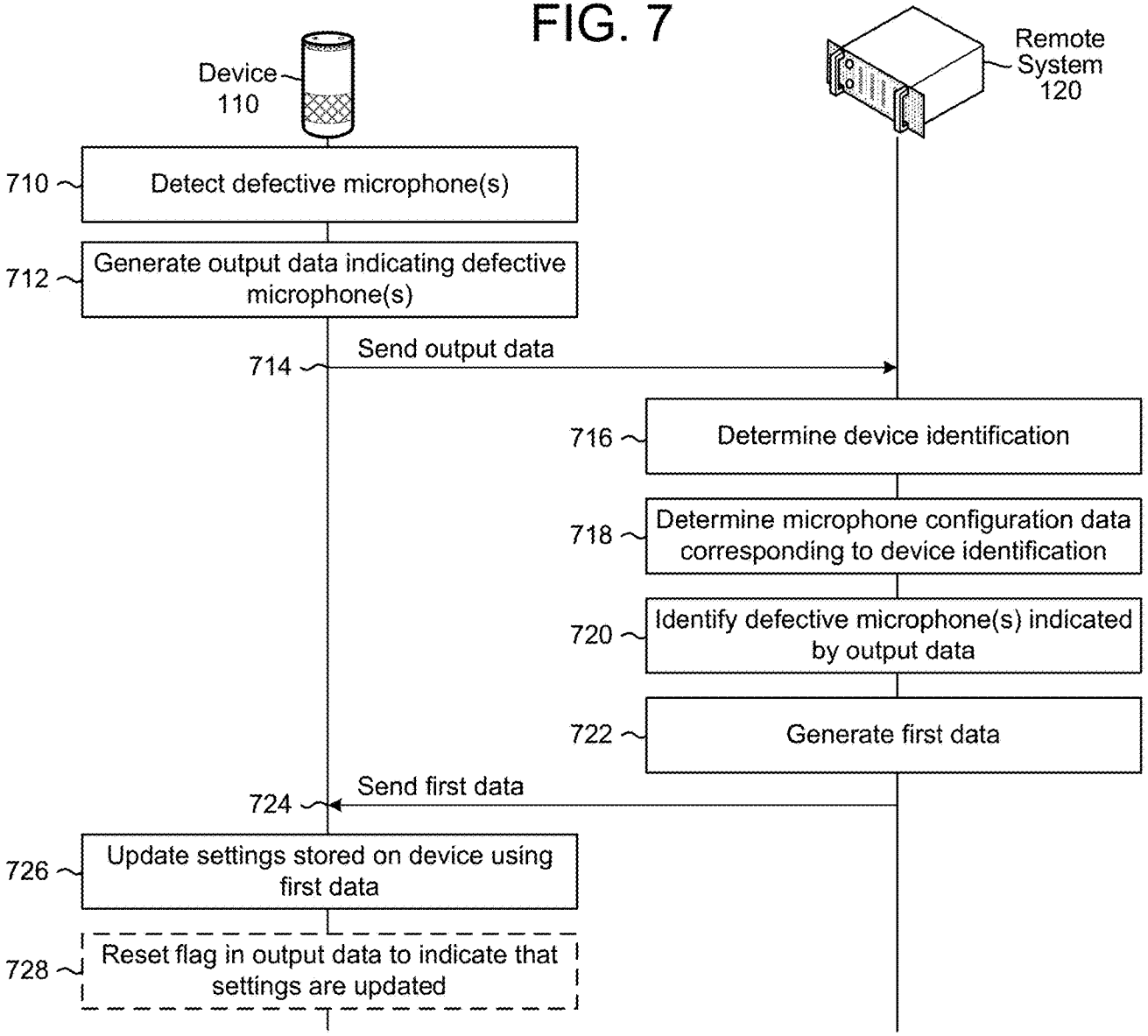
FIG. 7 is a communication diagram conceptually illustrating an example method for updating settings using a remote system according to embodiments of the present disclosure.

FIG. 7 is a communication diagram conceptually illustrating an example method for updating settings using a remote system according to embodiments of the present disclosure. As described above, the device 110 and/or the remote system 120 may calculate new configuration settings (e.g., beamformer coefficients and/or other parameters) or parameters of the configuration settings based on functional microphones without departing from the disclosure. While the device 110 may calculate the new configuration settings independently from the remote system 120, FIG. 7 illustrates an example conceptually illustrating how the remote system 120 may calculate the configuration settings and send them to the device 110.

As illustrated in FIG. 7, the device 110 may detect (710) defective microphone(s) 112 by performing microphone failure detection as described above. The device 110 may generate (712) output data indicating the defective microphone(s) and may send (714) the output data to the remote system 120.

The remote system 120 may determine (716) device identification unique to the device 110 and may determine (718) microphone configuration data corresponding to the device identification. For example, the output data and/or audio data associated with the device 110 may include the unique identification associated with the device 110 and the remote system 120 may determine the device identification based on the output data and/or the audio data. The remote system 120 may use the device identification to identify the microphone configuration data associated with the device 110 in a device dictionary stored on the remote system 120. The remote system 120 may identify (720) defective microphone(s) indicated by the output data, may generate (722) first data based on the defective microphone(s) and may send (724) the first data to the device 110. For example, the first data may correspond to beamformer coefficient values calculated using functional microphones (e.g., excluding the defective microphone(s)) and/or the like.

The device 110 may receive the first data, may update (726) settings (e.g., configuration settings) stored on the device using the first data, and may optionally reset (728) a flag in the output data to indicate that the settings are updated.

FIGS. 8A-8C illustrate examples of microphone dictionaries, device dictionaries, and configuration dictionaries according to embodiments of the present disclosure. As illustrated in FIG. 8A, a microphone dictionary 810 may include an update required flag 812 and a plurality of defective microphone flags 814 corresponding to the number of microphones 112 associated with the device 110. For example, if there are eight microphones 112 in the microphone array on the device 110, the microphone dictionary 810 may include a single update required flag 812 and eight individual defective microphone flags 814. The microphone dictionary 810 illustrated in FIG. 8A corresponds to the device 110 determining that a second microphone (Mic2) is defective, which results in the device 110 setting the update required flag 812 (e.g., to indicate that the current configuration settings include the defective microphone) and a second defective microphone flag 814*b*.

While FIG. 8A illustrates the flags being set using an "X," this is intended to convey that the microphone dictionary 810 indicates that a specific microphone is defective using any technique known to one of skill in the art. For example, the microphone dictionary 810 may include a unique identifier associated with the second microphone, although the disclosure is not limited thereto.

In some examples, the microphone dictionary may indicate the defective microphone(s) using binary values, as illustrated by microphone dictionary 820. For example, microphone dictionary 820 illustrates that the update required flag 822 and the second microphone flag 824*b* are set using a binary value of one, with all other flags corresponding to a binary value of zero. However, the disclosure is not limited thereto and selected flags may be indicated using a binary value of zero and/or using any other technique known to one of skill in the art without departing from the disclosure.

In some examples, the microphone dictionary can indicate additional information beyond whether a microphone is defective. For example, the device 110 may detect an attenuation and/or phase shift associated with the microphone, enabling the system 100 to compensate for the attenuation and/or phase shift without considering the microphone defective. As will be described in greater detail below, the device 110 may determine the attenuation and/or phase shift by comparing input audio data received from an individual microphone to expected audio data associated with the microphone, such as by calculating a cross correlation and/or the like. In some examples, the device 110 may determine the expected audio data based on reference audio data, such as output audio data sent to the loudspeaker(s) 114. For example, the device 110 may calculate the expected audio data based on the output audio data and a transfer function associated with the microphone (e.g., acoustic echo transfer function), although the disclosure is not limited thereto. In other examples, the device 110 may determine the expected audio data based on the remaining microphones 112 in the microphone array. For example, if the microphone array includes eight microphones 112*a*-112*h*, the device 110 may determine expected audio data for a first microphone 112*a* based on input audio data associated with the remaining seven microphones 112*b*-112*h*.

As illustrated in FIG. 8A, a microphone dictionary 830 may include an update required flag 832 and microphone data 834 corresponding to the microphones 112 associated with the device 110. For example, the microphone data 834 may indicate whether a microphone is defective (e.g., non-functional), an attenuation value (e.g., gain estimate) associated with the microphone, a phase shift value (e.g., delay estimate) associated with the microphone, and/or the like, although the disclosure is not limited thereto.

To illustrate an example, the microphone dictionary 830 indicates that a first microphone Mic1 is operating normally (e.g., not defective, with no measurable attenuation or phase shift), a second microphone Mic2 is functional but experiencing an attenuation of 10 dB and a phase shift of 60 degrees, and a third microphone MicN is defective. In the example illustrated in FIG. 8A, the microphone dictionary 830 does not include an attenuation value and/or phase shift value if the microphone is operating normally (e.g., Mic1) or when it is defective (e.g., MicN). However, the disclosure is not limited thereto and the microphone dictionary may indicate an attenuation value and/or phase shift value for every microphone without departing from the disclosure.

As the device 110 determined that one of the microphones is attenuated (e.g., Mic2) and/or defective (e.g., MicN), the device 110 may set the update required flag 832 and send the microphone dictionary 830 as output data to the remote system 120. Using the microphone dictionary 830, the remote system 120 may calculate updated parameters and/or settings that improve a performance of the device 110. For example, the remote system 120 may calculate updated beamformer coefficients for the seven functional microphones 112 (e.g., including the second microphone Mic2, but ignoring the third microphone MicN completely) that compensate for the attenuation value and/or phase shift value associated with the second microphone Mic2.

The device 110 and/or the remote system 120 may store the microphone dictionary 810/820/830 and may use the microphone dictionary 810/820/830 to determine which microphone(s) 112 are defective and/or whether updated settings are required. For example, once the remote system 120 calculates updated settings (e.g., first data) and sends the first data to the device 110, the device 110 may update the microphone dictionary 810/820/830 to unselect the update required flag 812/822/832.

FIG. 8B illustrates examples of device dictionaries that may be stored on the remote system 120 and used to determine microphone configurations for an individual device 110 using the device identification. For example, device dictionary 840 illustrates information associated with a plurality of devices 110, including a microphone configuration and/or defective microphone(s) associated with an individual device 110. Thus, based on the device identification, the remote system 120 may determine a corresponding microphone configuration (e.g., number of microphones, arrangement or orientation of the microphone array, etc.) and which microphones 112 are functional and/or defective.

In some examples, the remote system 120 may store additional information in the device dictionary, as illustrated by device dictionary 850. For example, device dictionary 850 may indicate a device class, a model, a version, a number of microphones, a microphone configuration (e.g., arrangement or orientation), an indication of defective microphone(s), additional microphone data (e.g., attenuation and/or phase shift for a functional microphone), and/or the like. However, this is intended as an illustrative example and the disclosure is not limited thereto. Thus, the device dictionary may include any information associated with identifying a particular device and/or microphones 112 of the particular device 110 without departing from the disclosure.

In some examples, the device 110 may store preconfigured settings corresponding to potential microphone configurations and update settings locally using the preconfigured settings. For example, the remote system 120 may calculate the preconfigured settings (e.g., beamformer coefficients and/or the like) for each microphone configuration and the device 110 may store the preconfigured settings for later reference. Thus, if the device 110 determines that a microphone is defective, the device 110 may identify a current microphone configuration based on the remaining functional microphones, identify preconfigured settings corresponding to the current microphone configuration, and update settings on the device 110 using the preconfigured settings. As a result, the device 110 may update the settings based on the defective microphone without sending the output data to the remote system 120 or receiving the first data from the remote system 120.

As illustrated in FIG. 8C, a configuration dictionary 860 illustrates an example of preconfigured settings for a circular microphone array that includes eight microphones. As the circular microphone array is symmetrical, all potential combinations of defective microphones can be simplified to unique microphone configurations based on a relative position of the defective microphones, reducing a number of preconfigured settings to store in the configuration dictionary 860. For example, a single defective microphone corresponds to second preconfigured settings (e.g., Settings 2), regardless of which microphone is defective. Thus, the device 110 may apply the second preconfigured settings to the seven remaining functional microphones based on a position of the defective microphone. Similarly, every potential combination of two defective microphones corresponds to only four unique microphone configurations—no gap (e.g., neighboring defective microphones), one gap (e.g., two defective microphones separated by one functional microphone), two gap (e.g., two defective microphones separated by two functional microphones), or three gap (e.g., two defective microphones separated by three functional microphones).

As illustrated in the configuration dictionary 860, a first microphone configuration that corresponds to all eight microphones being functional (e.g., no defective microphones) may be associated with first preconfigured settings (e.g., Settings 1), a second microphone configuration that corresponds to seven functional microphones (e.g., one defective microphone) may be associated with second preconfigured settings (e.g., Settings 2), a third microphone configuration that corresponds to six functional microphones (e.g., two neighboring defective microphones) may be associated with third preconfigured settings (e.g., Settings 3), a fourth microphone configuration that corresponds to six functional microphones (e.g., two defective microphones separated by a functional microphone) may be associated with fourth preconfigured settings (e.g., Settings 4), a fifth microphone configuration that corresponds to six functional microphones (e.g., two defective microphones separated by two functional microphones) may be associated with fifth preconfigured settings (e.g., Settings 5), a sixth microphone configuration that corresponds to six functional microphones (e.g., two defective microphones separated by three functional microphones) may be associated with sixth preconfigured settings (e.g., Settings 6), and so on until a final microphone configuration that corresponds to one functional microphone (e.g., seven defective microphones) may be associated with final preconfigured settings (e.g., Settings Z).

While the configuration dictionary 860 shows a simplified version of preconfigured settings, the disclosure is not limited thereto and in some examples the system 100 may generate preconfigured settings for every potential combination of defective microphones without departing from the disclosure. As illustrated in FIG. 8C, configuration dictionary 870 illustrates an example of storing unique preconfigured settings for every potential combination. For example, a first microphone configuration that corresponds to all eight microphones being functional (e.g., no defective microphones) may be associated with first preconfigured settings (e.g., Settings 0), a second microphone configuration that corresponds to seven functional microphones and a defective first microphone Mic1 may be associated with second preconfigured settings (e.g., Settings 1a), a third microphone configuration that corresponds to seven functional microphones and a defective second microphone Mic2 may be associated with third preconfigured settings (e.g., Settings 1b), a fourth microphone configuration that corresponds to seven functional microphones and a defective eighth microphone Mic8 may be associated with fourth preconfigured settings (e.g., Settings 1h), a fifth microphone configuration that corresponds to six functional microphones (e.g., first microphone Mic1 and second microphone Mic2 being defective) may be associated with fifth preconfigured settings (e.g., Settings 2a), and so on for every potential combination.

While FIG. 8C illustrates the configuration dictionary 860/870 including the preconfigured settings, the disclosure is not limited thereto and the preconfigured settings may correspond to a portion of the overall settings, such as individual parameters (e.g., beamformer coefficients) and/or the like without departing from the disclosure.

Figure 9A:
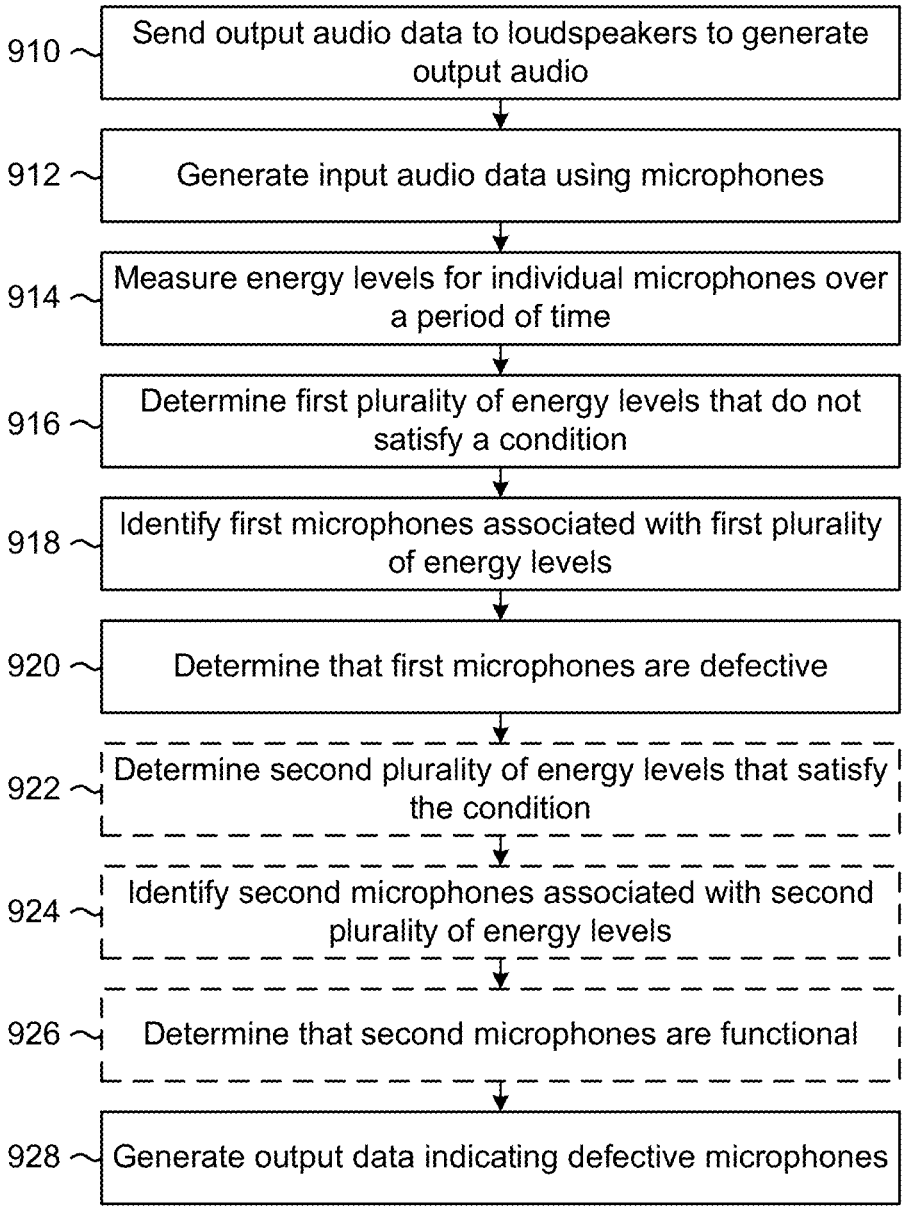
FIGS. 9A-9C are flowcharts conceptually illustrating example methods for performing microphone failure detection according to embodiments of the present disclosure.
Figure 9B:
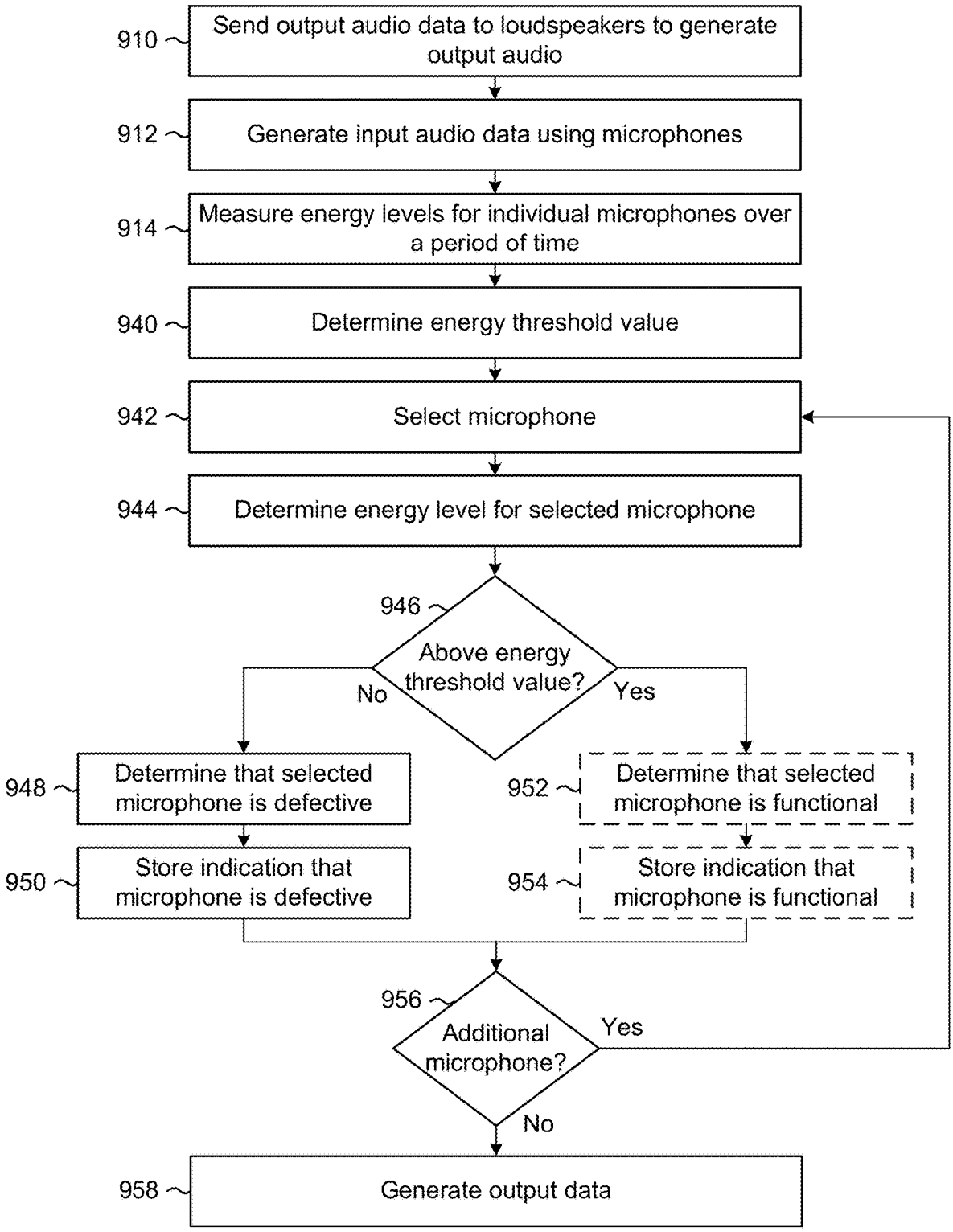
Figure 9C:
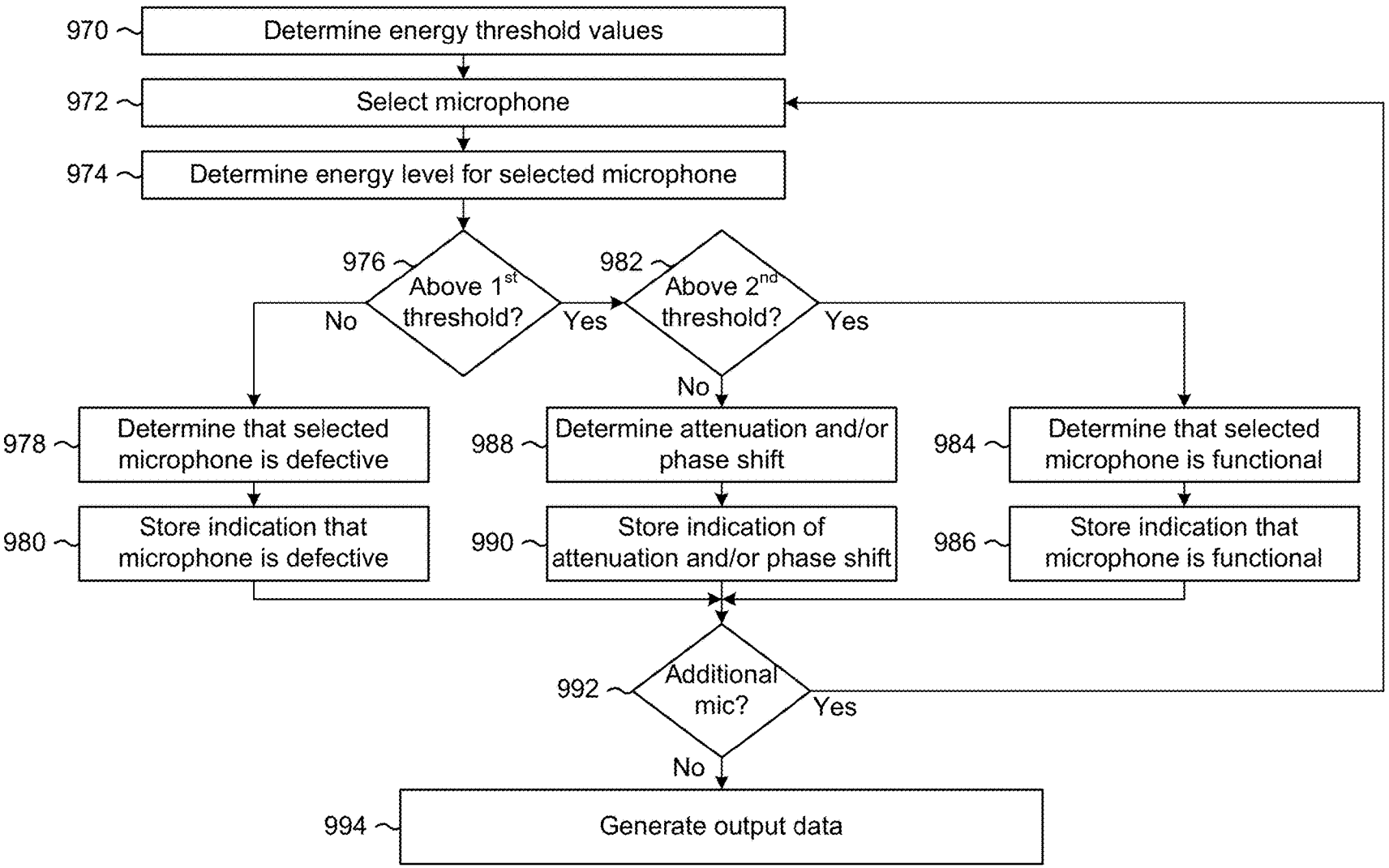

FIGS. 9A-9C are flowcharts conceptually illustrating example methods for performing microphone failure detection according to embodiments of the present disclosure. As illustrated in FIG. 9A, the device 110 may send (910) output data to loudspeakers 114 to generate output audio, may generate (912) input audio data using microphones 112, and may measure (914) energy levels for individual microphones over a period of time (e.g., 30 seconds).

The device 110 may determine (916) a first plurality of energy levels that do not satisfy a condition (e.g., below a threshold value, such as an absolute threshold value or a relative threshold value), identify (918) first microphones associated with the first plurality of energy levels, and determine (920) that the first microphones are defective. In some examples, the device 110 may optionally determine (922) a second plurality of energy levels that satisfy the condition (e.g., above a threshold value, such as an absolute threshold value or a relative threshold value), identify (924) second microphones associated with the second plurality of energy levels, and determine (926) that the second microphones are functional. However, the disclosure is not limited thereto and the device 110 may only determine the defective microphones without departing from the disclosure. The device 110 may then generate (928) output data indicating the defective microphones.

As illustrated in FIG. 9B, the device 110 may send (910) output audio data to loudspeakers 114 to generate output audio, may generate (912) input audio data using the microphones 112, and may measure (914) energy levels for individual microphones 112 over a period of time (e.g., 30 seconds). The device 110 may then determine (950) an energy threshold value and select (952) a microphone. For the selected microphone, the device 110 may determine (954) an energy level for the selected microphone and determine (956) whether the energy level is above the energy threshold value. If the energy level is not above the energy threshold value, the device 110 may determine (958) that the selected microphone is defective and may store (960) an indication that the selected microphone is defective. If the energy level is above the energy threshold value, the device 110 may optionally determine (962) that the selected microphone is functional and optionally store (964) an indication that the selected microphone is functional, as indicated by the dashed lines in FIG. 9B, although the disclosure is not limited thereto.

The device 110 may determine (966) whether there is an additional microphone and, if so, may loop to step 952 and repeat steps 952-964 for the additional microphone. If there isn't an additional microphone, the device 110 may generate (968) output data indicating the defective microphone(s).

In some examples, in addition to or instead of determining that an individual microphone is defective, the device 110 may identify an attenuation and/or phase shift associated with the individual microphone. This enables the system 100 to compensate for the attenuation and/or phase shift without considering the microphone defective. The device 110 may determine the attenuation and/or phase shift by comparing input audio data received from an individual microphone to expected audio data associated with the microphone, such as by calculating a cross correlation and/or the like. In some examples, the device 110 may determine the expected audio data based on reference audio data, such as output audio data sent to the loudspeaker(s) 114. For example, the device 110 may calculate the expected audio data based on the output audio data and a transfer function associated with the microphone (e.g., acoustic echo transfer function), although the disclosure is not limited thereto. In other examples, the device 110 may determine the expected audio data based on the remaining microphones 112 in the microphone array. For example, if the microphone array includes eight microphones 112*a*-112*h*, the device 110 may determine expected audio data for a first microphone 112*a* based on input audio data associated with the remaining seven microphones 112*b*-112*h*.

As illustrated in FIG. 9C, the device 110 may determine (970) energy threshold values, including a first energy threshold value indicating that a microphone is defective and a second energy threshold value indicating that a microphone is attenuated. While not illustrated in FIG. 9C, the device 110 may perform steps 910-914 to measure energy levels for individual microphones over a period of time, and these energy levels may be used to determine the energy threshold values. For example, the second energy threshold value may correspond to a minimum energy level of a group of functional microphones or an average energy level of the group of functional microphones, while the first energy threshold value may be an absolute energy level (e.g., 6 dB) or a relative energy level (e.g., offset from the second energy level by 6 dB).

The device 110 may select (972) a microphone, determine (974) an energy level for the selected microphone, and determine (976) whether the energy level is above the first energy threshold value. If the energy level is below the first energy threshold value, the device 110 may determine (978) that the selected microphone is defective and store (980) an indication that the selected microphone is defective, as described in greater detail above.

If the energy level is above the first energy threshold value, the device 110 may determine (982) whether the energy level is above the second energy threshold value. If the energy level is above the second energy threshold value, the device 110 may determine (984) that the selected microphone is functional and may store (986) an indication that the microphone is functional. If the energy level is below the second energy threshold value, the device 110 may determine (988) an attenuation and/or phase shift corresponding to the selected microphone and may store (990) an indication of the attenuation and/or phase shift.

The device 110 may then determine (992) whether there is an additional microphone and, if so, may loop to step 972 and repeat steps 972-990 for the additional microphone. If there are no additional microphones, the device 110 may generate (994) output data indicating that an individual microphone is functional, defective, and/or additional information (e.g., attenuation and/or phase shift) associated with the microphone.

Figure 10A:
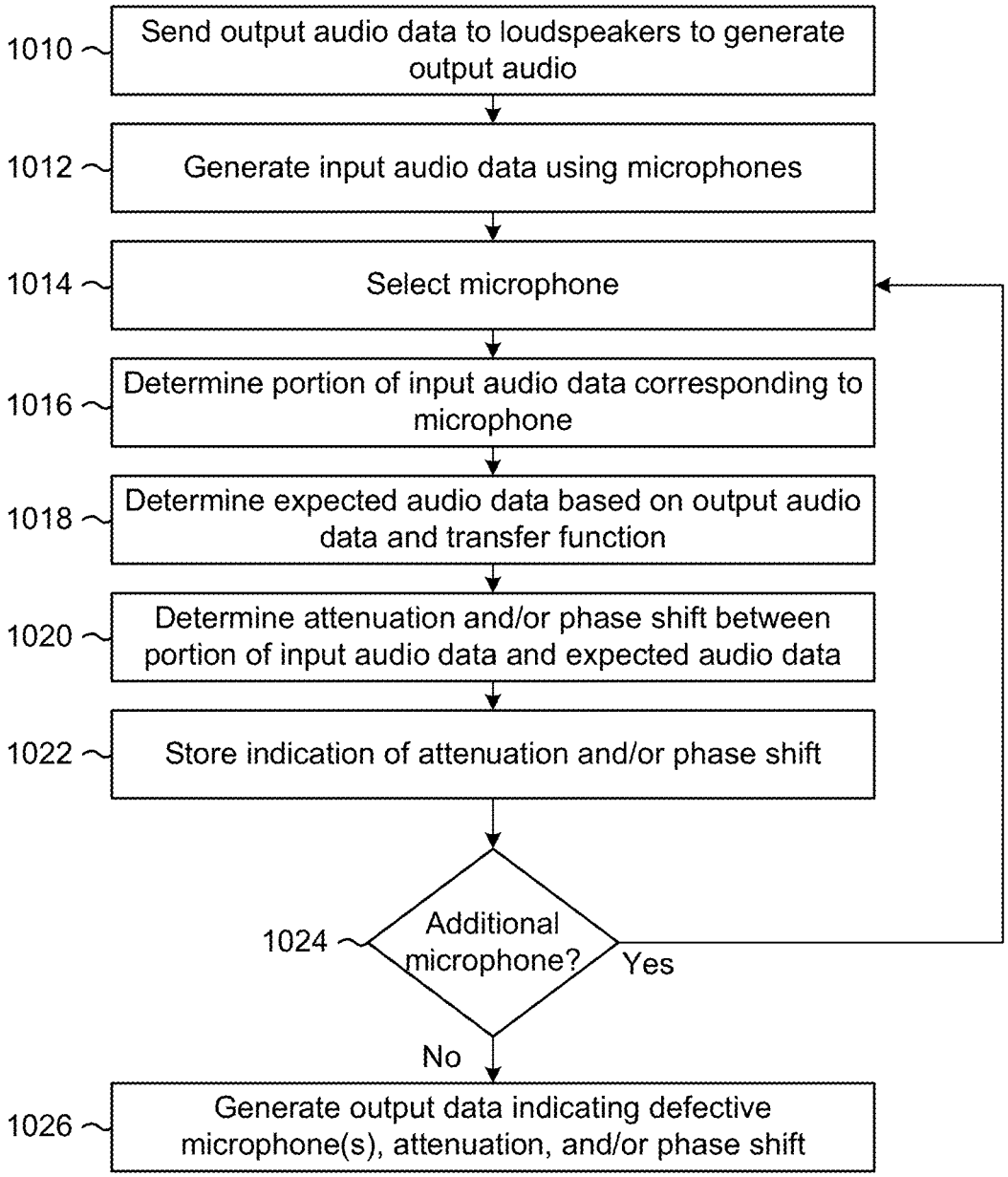
FIGS. 10A-10B are flowcharts conceptually illustrating example methods for performing phase shift detection according to embodiments of the present disclosure.
Figure 10B:
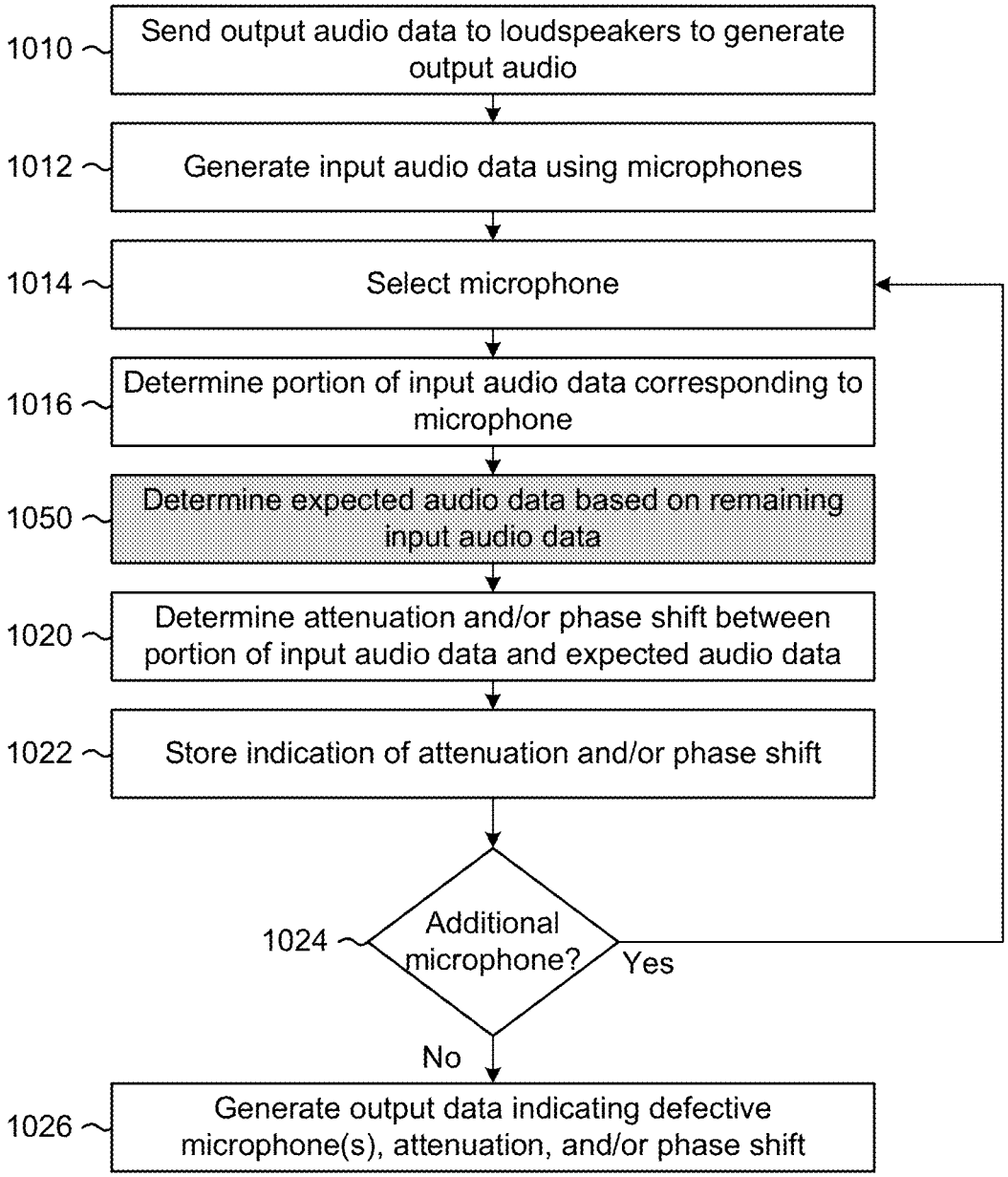

FIGS. 10A-10B are flowcharts conceptually illustrating example methods for performing phase shift detection according to embodiments of the present disclosure. As illustrated in FIG. 10A, the device 110 may send (1010) output audio data to loudspeakers to generate output audio and may generate (1012) input audio data using microphones.

The device 110 may select (1014) a microphone, determine (1016) a portion of the input audio data corresponding to the selected microphone, and determine (1018) expected audio data based on the output audio data and a transfer function (e.g., echo estimate transfer function) unique to the selected microphone. For example, the device 110 may estimate what portion of the output audio data is captured by the selected microphone.

The device 110 may determine (1020) an attenuation and/or phase shift between the portion of the input audio data and the expected audio data and store (1022) an indication of the attenuation and/or the phase shift. For example, the device 110 may generate cross-correlation data (e.g., calculate a cross correlation between the portion of the input audio data and the expected audio data) and determine the attenuation and/or phase shift based on the cross-correlation data.

The device 110 may determine (1024) whether there is an additional microphone and, if so, may loop to step 1014 and repeat steps 1014-1022 for the additional microphone. If there is not an additional microphone, the device 110 may generate (1026) output data indicating defective microphone(s), attenuation, and/or phase shifts. For example, the device 110 may determine that any attenuation above a threshold value corresponds to a defective microphone, although the disclosure is not limited thereto.

While FIG. 10A illustrates the device 110 estimating the expected audio data based on the output audio data using a transfer function, the disclosure is not limited thereto. In some examples, the device 110 may estimate the expected audio data using other microphones without departing from the disclosure.

As illustrated in FIG. 10B, the device 110 may send (1010) output audio data to loudspeakers to generate output audio and may generate (1012) input audio data using microphones.

The device 110 may select (1014) a microphone, determine (1016) a portion of the input audio data corresponding to the selected microphone, and determine (1050) expected audio data based on remaining input audio data. For example, the device 110 may determine first expected audio data for a first microphone Mic1 using microphones Mic2-Mic8, second expected audio data for a second microphone Mic2 using microphones Mic1 and Mic3-Mic8, and so on.

The device 110 may determine (1020) an attenuation and/or phase shift between the portion of the input audio data and the expected audio data and store (1022) an indication of the attenuation and/or the phase shift. For example, the device 110 may generate cross-correlation data (e.g., calculate a cross correlation between the portion of the input audio data and the expected audio data) and determine the attenuation and/or phase shift based on the cross-correlation data.

The device 110 may determine (1024) whether there is an additional microphone and, if so, may loop to step 1014 and repeat steps 1014-1022 for the additional microphone. If there is not an additional microphone, the device 110 may generate (1026) output data indicating defective microphone(s), attenuation, and/or phase shifts. For example, the device 110 may determine that any attenuation above a threshold value corresponds to a defective microphone, although the disclosure is not limited thereto.

Figure 11A:
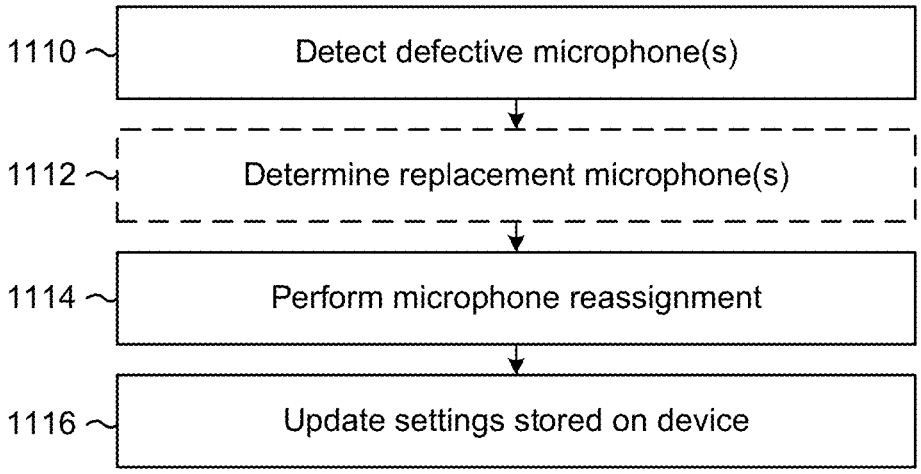
FIGS. 11A-11D are flowcharts conceptually illustrating example methods for updating settings according to embodiments of the present disclosure.

FIGS. 11A-11D are flowcharts conceptually illustrating example methods for updating settings according to embodiments of the present disclosure. As illustrated in FIG. 11A, the device 110 may detect (1110) defective microphone(s), may optionally determine (1112) replacement microphone(s) that are functional, may perform (1114) microphone reassignment, and may update (1116) settings stored on the device 110. For example, if the initial configuration selects a first microphone that is determined to be defective, the device 110 may determine that a second microphone is a replacement and perform microphone reassignment selecting the second microphone instead of the first microphone. However, the disclosure is not limited thereto, and if the initial configuration selects every microphone in the microphone array, the device 110 may generate an updated configuration selecting every microphone except the first microphone without departing from the disclosure.

Figure 11B:
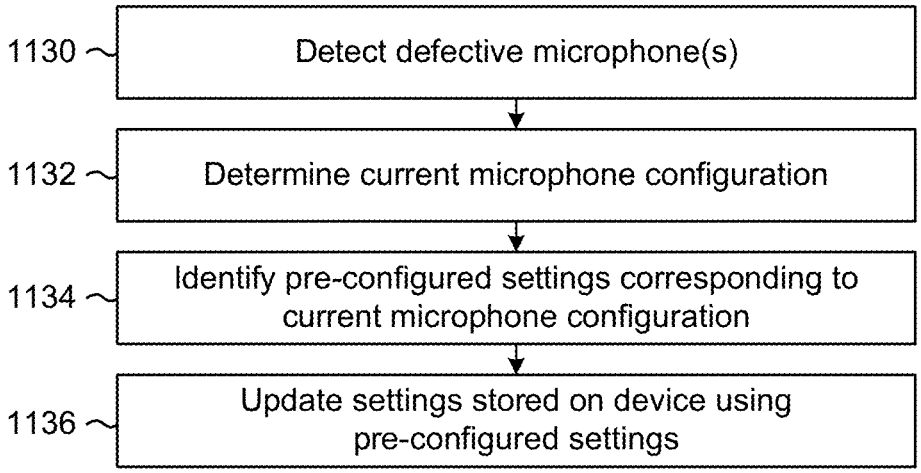

In some examples, the device 110 may store preconfigured settings locally on the device 110 and may update the settings using the preconfigured settings. As illustrated in FIG. 11B, the device 110 may detect (1130) defective microphone(s), may determine (1132) a current microphone configuration based on the functional microphones, may identify (1134) preconfigured settings corresponding to the current microphone configuration, and may update (1136) the settings stored on the device 110 using the preconfigured settings.

Figure 11C:
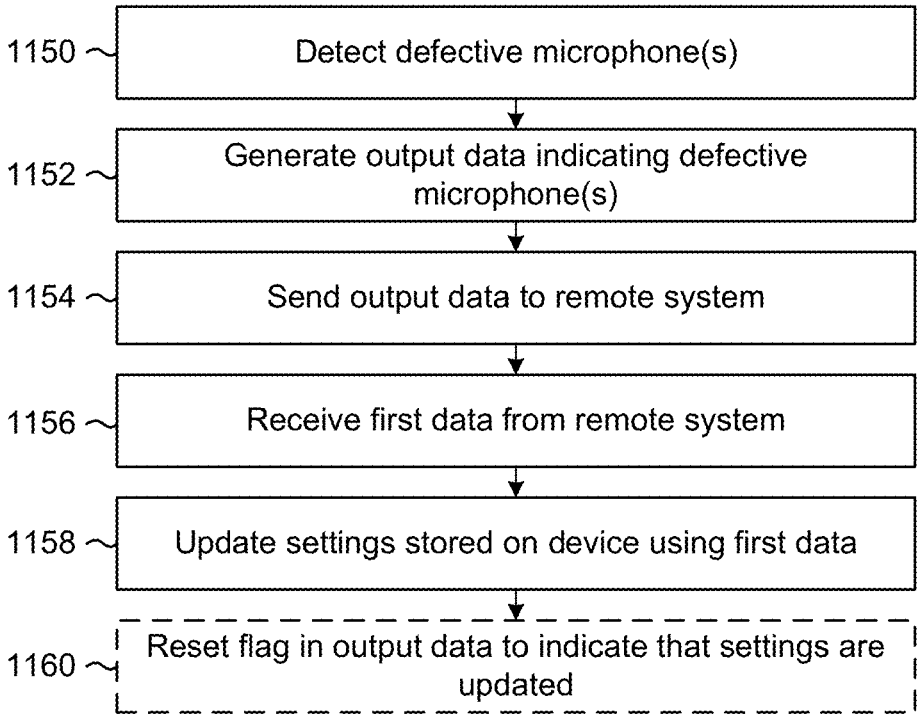

As illustrated in FIG. 11C, the device 110 may detect (1150) defective microphone(s), may generate (1152) output data indicating the defective microphone(s), and may send (1154) the output data to a remote system 120. As described above with regard to FIG. 7, the remote system 120 may generate first data based on the output data (e.g., recalculate beamformer coefficients without the defective microphone(s)). Thus, the device 110 may receive (1156) first data from the remote system 120, may update (1158) settings stored on the device using the first data, and may optionally reset (1160) a flag in the output data to indicate that the settings are updated, as discussed above with regard to FIG. 8A.

Figure 11D:
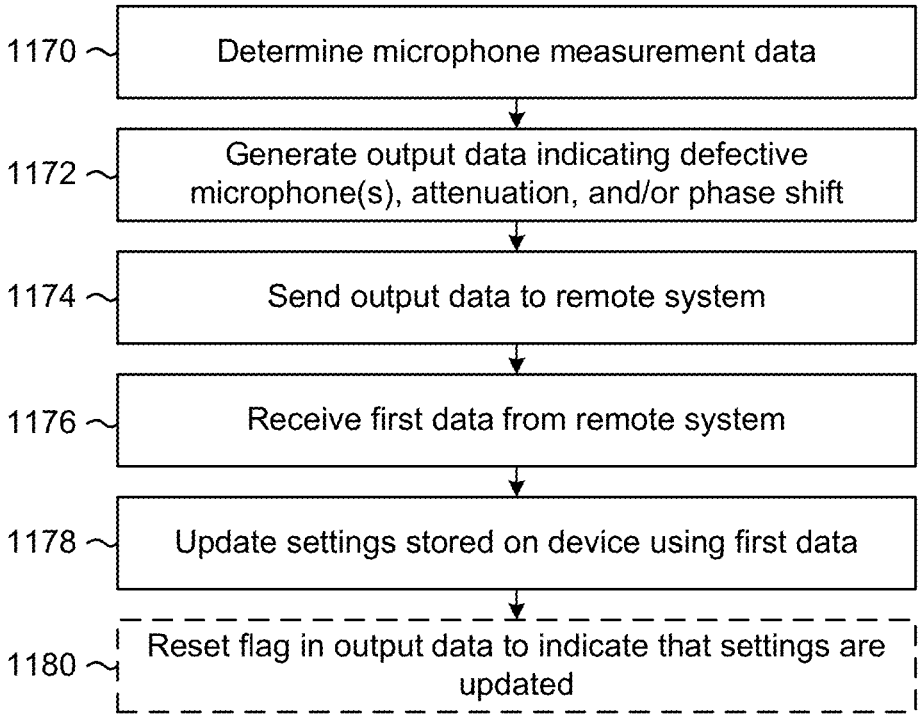

In some examples, the device 110 may determine an attenuation and/or phase shift in addition to and/or instead of determining which microphone(s) are defective. As illustrated in FIG. 11D, the device 110 may determine (1170) microphone measurement data, as described in greater detail above with regard to FIGS. 9C-10B, may generate (1172) output data indicating the defective microphone(s) as well as the attenuation and/or the phase shift for individual microphones, and may send (1174) the output data to a remote system 120. The remote system 120 may generate first data based on the output data (e.g., recalculate beamformer coefficients without the defective microphone(s) and/or to compensate for the attenuation and/or phase shift). Thus, the device 110 may receive (1176) first data from the remote system 120, may update (1178) settings stored on the device 110 using the first data, and may optionally reset (1180) a flag in the output data to indicate that the settings are updated.

While the above description refers to determining that microphone(s) are defective, in some situations a microphone may be intermittently functional or defective and/or may regain functionality. Thus, in some examples the system 100 may determine that a previously defective microphone is functional or that an attenuation and/or phase shift has changed significantly and update settings accordingly.

Figure 12A:
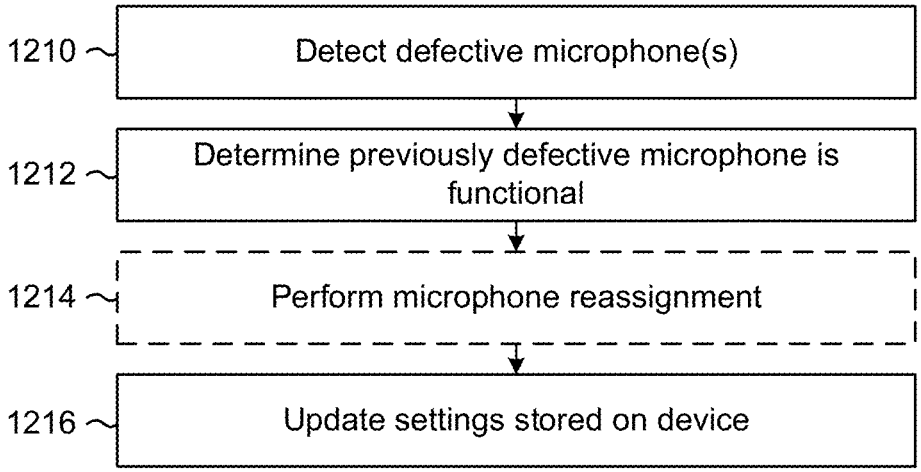
FIGS. 12A-12B are flowcharts conceptually illustrating example methods for updating settings when a microphone regains functionality according to embodiments of the present disclosure.
Figure 12B:
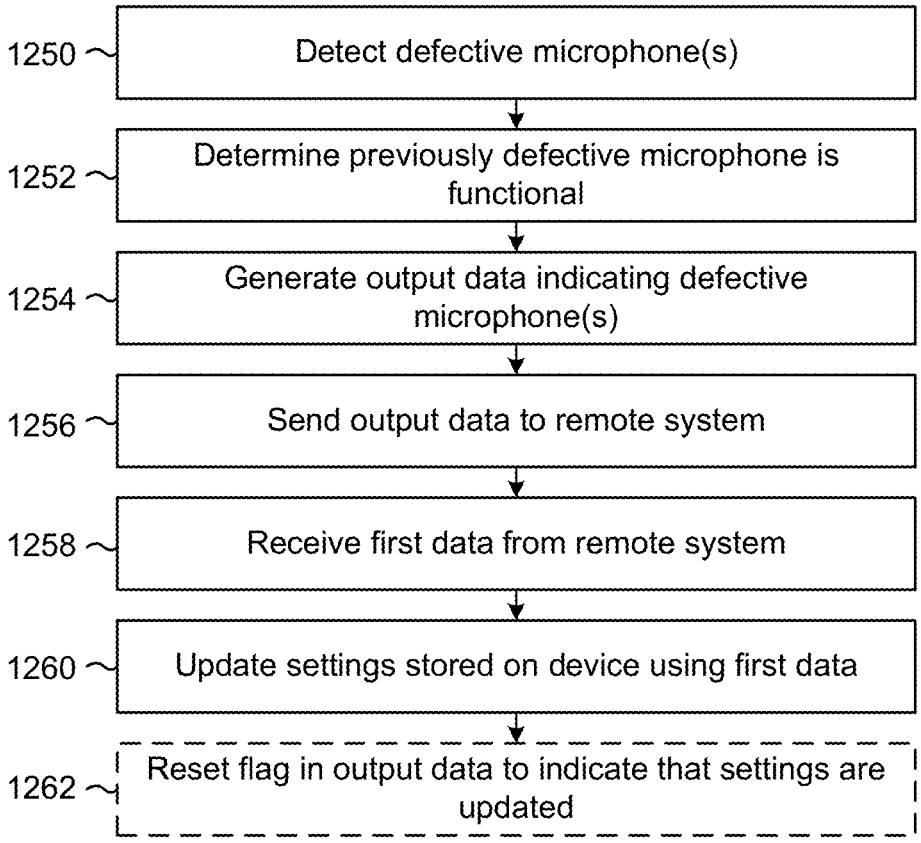

FIGS. 12A-12B are flowcharts conceptually illustrating example methods for updating settings when a microphone regains functionality according to embodiments of the present disclosure. As illustrated in FIG. 12A, the device 110 may detect (1210) defective microphone(s) and may determine (1212) that a previously defective microphone is functional. In some examples, the device 110 may optionally perform (1214) microphone reassignment to add the newly functional microphone to the microphone assignment. For example, if the microphone assignment indicates to generate input audio data using a plurality of microphones, the device 110 may add the newly functional microphone to the microphone assignment and generate input audio data with the newly functional microphone. However, the disclosure is not limited thereto and in other examples, the device 110 may continue with the existing microphone reassignment without departing from the disclosure. The device 110 may then update (1216) settings stored on the device based on the newly functional microphone.

As illustrated in FIG. 12B, the device 110 may detect (1250) defective microphone(s), determine (1252) that a previously defective microphone is functional, generate (1254) output data indicating the defective microphone(s), and send (1256) the output data to the remote system 120. The remote system 120 may calculate first data based on the output data, such as recalculating beamformer coefficient values including the newly functional microphone, and send the first data to the device 110. Thus, the device 110 may receive (1258) the first data from the remote system, may update (1260) settings stored on the device using the first data, and may optionally reset (1262) a flag in the output data to indicate that the settings are updated, as discussed above with regard to FIG. 8A.

While FIG. 11B is described with regard to detecting that a microphone is defective, the disclosure is not limited thereto and the device 110 may perform the same steps to determine that a previously defective microphone is no longer defective and update settings accordingly using preconfigured settings. For example, the device 110 may determine that a previously defective microphone is functional, determine a current microphone configuration, and select preconfigured settings based on the current microphone configuration, as illustrated in FIG. 11B.

Similarly, while FIG. 11D is described with regard to sending output data to the remote system 120 when a microphone is determined to be defective, the disclosure is not limited thereto and the device 110 may send output data to the remote system 120 when a microphone is determined to no longer be defective without departing from the disclosure.

Figure 13:
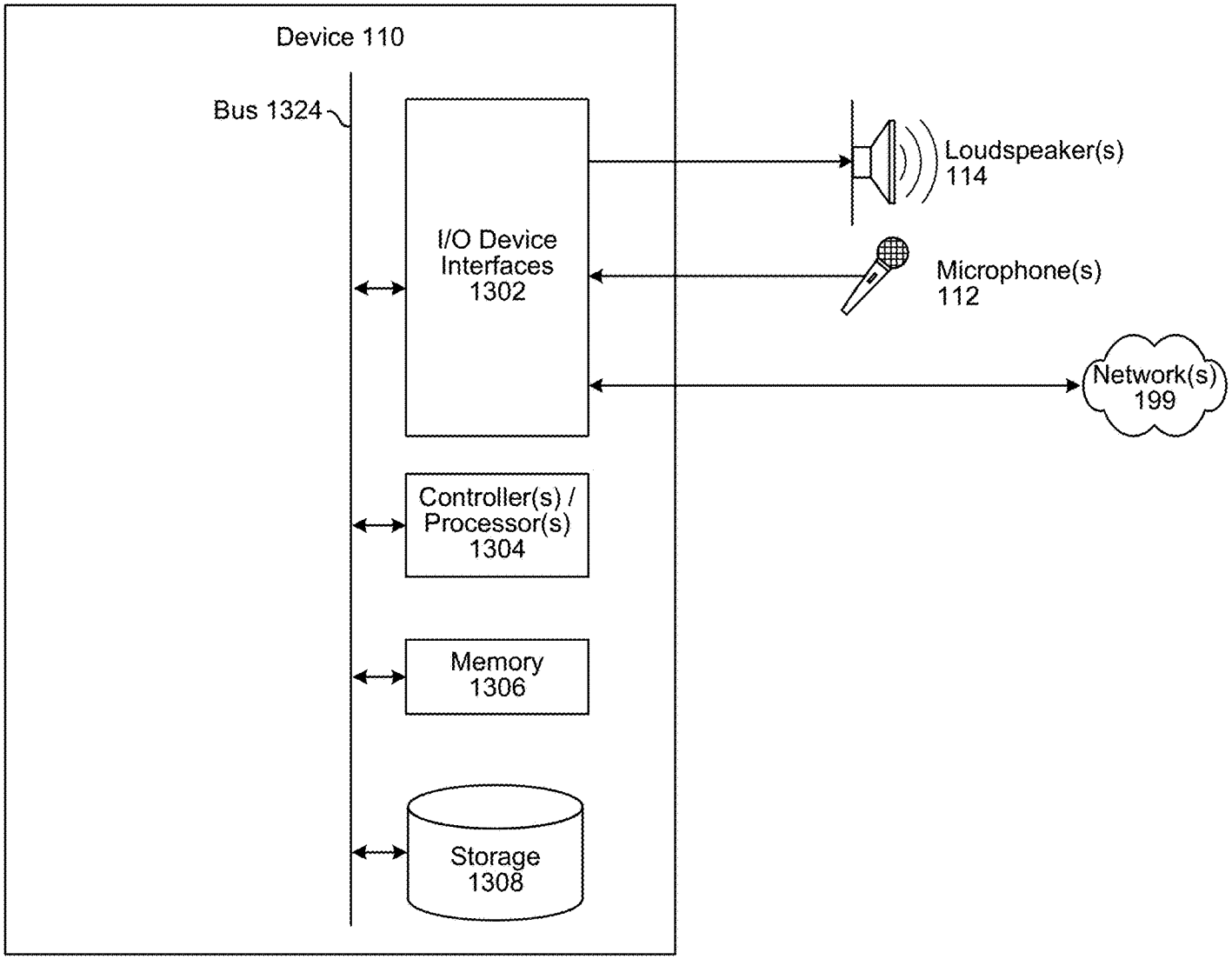
FIG. 13 is a block diagram conceptually illustrating example components of a device according to embodiments of the present disclosure.
Figure 14:
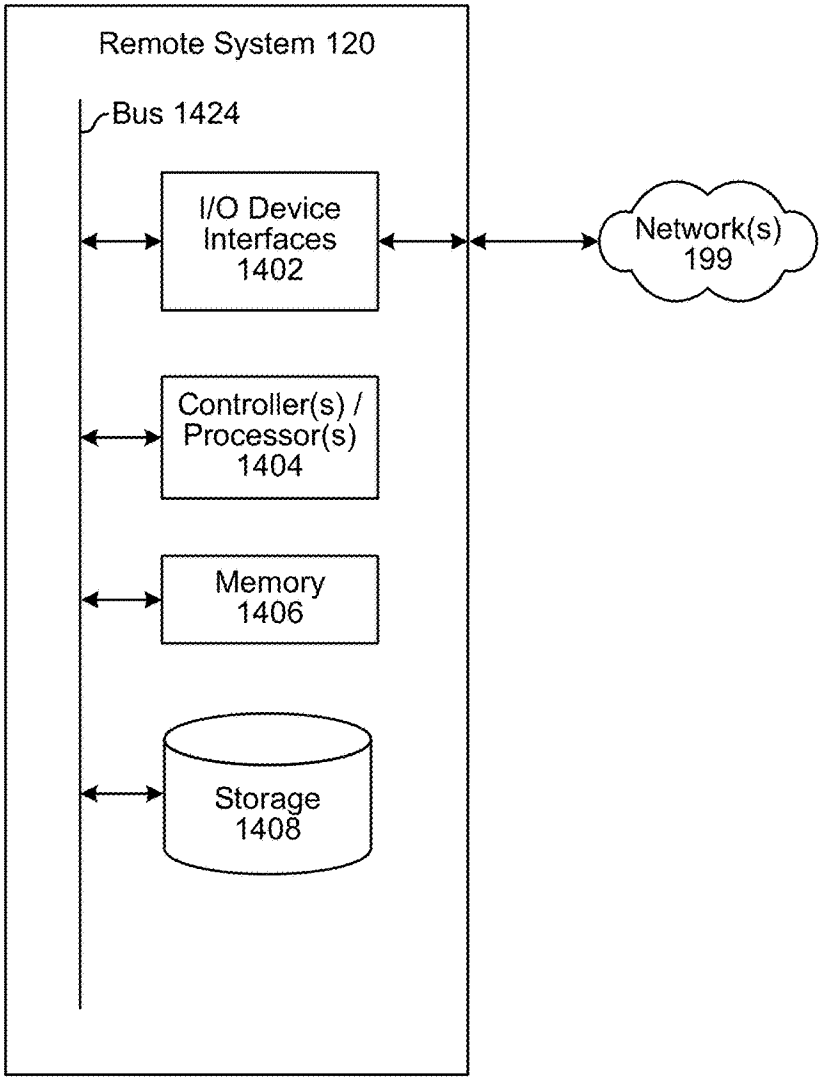
FIG. 14 is a block diagram conceptually illustrating example components of a remote system according to embodiments of the present disclosure.

FIG. 13 is a block diagram conceptually illustrating a device 110 that may be used with the system. FIG. 14 is a block diagram conceptually illustrating example components of a remote device, such as the remote system 120, which may assist with recalculating settings to compensate for defective microphone(s). The term "server" as used herein may refer to a traditional server as understood in a server/client computing structure but may also refer to a number of different computing components that may assist with the operations discussed herein. For example, a server may include one or more physical computing components (such as a rack server) that are connected to other devices/components either physically and/or over a network and is capable of performing computing operations. A server may also include one or more virtual machines that emulates a computer system and is run on one or across multiple devices. A server may also include other combinations of hardware, software, firmware, or the like to perform operations discussed herein. The server(s) may be configured to operate using one or more of a client-server model, a computer bureau model, grid computing techniques, fog computing techniques, mainframe techniques, utility computing techniques, a peer-to-peer model, sandbox techniques, or other computing techniques.

Multiple servers may be included in the remote system 120. In operation, each of these devices (or groups of devices) may include computer-readable and computer-executable instructions that reside on the respective device (110/120), as will be discussed further below.

Each of these devices (110/120) may include one or more controllers/processors (1304/1404), which may each include a central processing unit (CPU) for processing data and computer-readable instructions, and a memory (1306/1406) for storing data and instructions of the respective device. The memories (1306/1406) may individually include volatile random access memory (RAM), non-volatile read only memory (ROM), non-volatile magnetoresistive memory (MRAM), and/or other types of memory. Each device (110/120) may also include a data storage component (1308/1408) for storing data and controller/processor-executable instructions. Each data storage component (1308/1408) may individually include one or more non-volatile storage types such as magnetic storage, optical storage, solid-state storage, etc. Each device (110/120) may also be connected to removable or external non-volatile memory and/or storage (such as a removable memory card, memory key drive, networked storage, etc.) through respective input/output device interfaces (1302/1402).

Computer instructions for operating each device (110/120) and its various components may be executed by the respective device's controller(s)/processor(s) (1304/1404), using the memory (1306/1406) as temporary "working" storage at runtime. A device's computer instructions may be stored in a non-transitory manner in non-volatile memory (1306/1406), storage (1308/1408), or an external device(s). Alternatively, some or all of the executable instructions may be embedded in hardware or firmware on the respective device in addition to or instead of software.

Each device (110/120) includes input/output device interfaces (1302/1402). A variety of components may be connected through the input/output device interfaces (1302/1402), as will be discussed further below. Additionally, each device (110/120) may include an address/data bus (1324/1424) for conveying data among components of the respective device. Each component within a device (110/120) may also be directly connected to other components in addition to (or instead of) being connected to other components across the bus (1324/1424).

Referring to FIG. 13, the device 110 may include input/output device interfaces 1302 that connect to a variety of components such as an audio output component such as a loudspeaker(s) 114, a wired headset or a wireless headset (not illustrated), or other component capable of outputting audio. The device 110 may also include an audio capture component. The audio capture component may be, for example, microphone(s) 112 or array of microphones, a wired headset or a wireless headset (not illustrated), etc. If an array of microphones is included, approximate distance to a sound's point of origin may be determined by acoustic localization based on time and amplitude differences between sounds captured by different microphones of the array. The device 110 may additionally include a display 1316 for displaying content. The device 110 may further include a camera 1318.

Via antenna(s) 1314, the input/output device interfaces 1302 may connect to one or more networks 199 via a wireless local area network (WLAN) (such as WiFi) radio, Bluetooth, and/or wireless network radio, such as a radio capable of communication with a wireless communication network such as a Long Term Evolution (LTE) network, WiMAX network, 3G network, 4G network, 5G network, etc. A wired connection such as Ethernet may also be supported. Through the network(s) 199, the system may be distributed across a networked environment. The I/O device interface (1302/1402) may also include communication components that allow data to be exchanged between devices such as different physical servers in a collection of servers or other components.

The components of the device(s) 110 and the remote system 120 may include their own dedicated processors, memory, and/or storage. Alternatively, one or more of the components of the device(s) 110 and the remote system 120 may utilize the I/O interfaces (1302/1402), processor(s) (1304/1404), memory (1306/1406), and/or storage (1308/1408) of the device(s) 110 and remote system 120, respectively. Thus, the ASR component 250 may have its own I/O interface(s), processor(s), memory, and/or storage; the NLU component 260 may have its own I/O interface(s), processor(s), memory, and/or storage; and so forth for the various components discussed herein.

As noted above, multiple devices may be employed in a single system. In such a multi-device system, each of the devices may include different components for performing different aspects of the system's processing. The multiple devices may include overlapping components. The components of the device 110 and the remote system 120, as described herein, are illustrative, and may be located as a stand-alone device or may be included, in whole or in part, as a component of a larger device or system.

The concepts disclosed herein may be applied within a number of different devices and computer systems, including, for example, general-purpose computing systems, speech processing systems, and distributed computing environments.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of computers and speech processing should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk, and/or other media. In addition, components of system may be implemented as in firmware or hardware, such as an acoustic front end (AFE), which comprises, among other things, analog and/or digital filters (e.g., filters configured as firmware to a digital signal processor (DSP)).

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements, and/or steps are in any way required for one or more embodiments or that one or more embodiments necessarily include logic for deciding, with or without other input or prompting, whether these features, elements, and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method comprising, by a voice-controlled device:

storing first configuration data corresponding to a first group of microphones that includes a first microphone and a second microphone;

storing second configuration data corresponding to a second group of microphones that includes the first microphone but not the second microphone;

after storing the first configuration data and the second configuration data:

sending first audio data to a loudspeaker to be output as audible sound;

receiving second audio data originating at a first microphone associated with the voice-controlled device, the second audio data including a first representation of the audible sound;

receiving third audio data originating at a second microphone associated with the voice-controlled device;

determining a first energy value associated with at least a portion of the second audio data, the at least a portion of the second audio data corresponding to a first time range;

determining a second energy value associated with at least a portion of the third audio data, the at least a portion of the third audio data corresponding to the first time range;

determining that the first energy value is above an energy threshold;

based at least in part on determining that the first energy value is above the energy threshold, determining that the first microphone is functioning properly;

determining that the second energy value is below the energy threshold;

based at least in part on determining that the second energy value is below the energy threshold, determining that the second microphone is malfunctioning; and based at least in part on determining that the second microphone is malfunctioning, using the second configuration data to detect a first spoken input.

2. The computer-implemented method of claim 1, further comprising:

establishing a communication session with a second device;

generating fourth audio data using one or more microphones excluding the second microphone, the fourth audio data including a representation of speech; and sending the fourth audio data to the second device.

3. The computer-implemented method of claim 1, wherein:

storing the first configuration data comprises storing first beamformer coefficient data corresponding to the first group of microphones; and storing the second configuration data comprises storing second beamformer coefficient data corresponding to the second group of microphones.

4. The computer-implemented method of claim 1, further comprising:

determining expected audio data corresponding to the second microphone;

determining, using the second audio data and the expected audio data, at least one of an attenuation value or a phase shift value associated with the second audio data; and determining that the second microphone is malfunctioning based on at least one of the attenuation value or the phase shift value.

5. The computer-implemented method of claim 1, further comprising:

after determining that the second microphone is malfunctioning, receiving fourth audio data associated with the second microphone;

determining that a third energy level, associated with the forth audio data, is above the energy threshold;

based at least in part on determining that the third energy level is above the energy threshold, determining that the second microphone is no longer malfunctioning; and based at least in part on determining that the second microphone is no longer malfunctioning, using the first configuration data to detect a second spoken input.

6. A computer-implemented method comprising, by a device:

storing first configuration data corresponding to a first group of microphones that includes a first microphone and a second microphone;

storing second configuration data corresponding to a second group of microphones that includes the first microphone but not the second microphone;

after storing the first configuration data and the second configuration data:

receiving first audio data associated with a first microphone;

determining that a first energy level, associated with the first audio data, is within a first range;

based at least in part on determining that the first energy level is within the first range, determining the first microphone is functioning properly;

receiving second audio data associated with a second microphone;

determining that a second energy level, associated with the second audio data, is outside of the first range;

based at least in part on determining that the second energy level is outside of the first range, determining that the second microphone is malfunctioning; and based at least in part on determining that the second microphone is malfunctioning, using the second configuration data to detect a first spoken input.

7. The computer-implemented method of claim 6, wherein:

storing the first configuration data comprises storing first beamformer coefficient data corresponding to the first group of microphones; and storing the second configuration data comprises storing second beamformer coefficient data corresponding to the second group of microphones.

8. The computer-implemented method of claim 6, further comprising:

establishing a communication session with a second device;

generating third audio data using one or more microphones excluding the second microphone; and sending the third audio data to the second device.

9. The computer-implemented method of claim 6, wherein:

determining that the first energy level is within the first range comprises:

determining that at least a portion of the first audio data corresponds to a first energy value, the at least a portion of the first audio data corresponding to a first time range, and determining that the first energy value is above a threshold value; and determining that the second energy level is outside of the first range comprises:

determining that at least a portion of the second audio data corresponds to a second energy value, the at least a portion of the second audio data corresponding to the first time range, and determining that the second energy value is below the threshold value.

10. The computer-implemented method of claim 6, further comprising:

determining expected audio data corresponding to the second microphone;

determining, using the second audio data and the expected audio data, at least one of an attenuation value or a phase shift value associated with the second audio data; and determining that the second microphone is malfunctioning based on at least one of the attenuation value or the phase shift value.

11. The computer-implemented method of claim 10, wherein determining the expected audio data comprises:

generating the expected audio data using third audio data, output by the device, and a transfer function associated with the second microphone.

12. The computer-implemented method of claim 10, wherein determining the expected audio data comprises:

generating the expected audio data using input audio data associated with the second group of microphones.

13. The computer-implemented method of claim 6, further comprising:

after determining that the second microphone is malfunctioning, receiving third audio data associated with the second microphone;

determining that a third energy level, associated with the third audio data, is within the first range;

based at least in part on determining that the third energy level is within the first range, determining that the second microphone is no longer malfunctioning; and based at least in part on determining that the second microphone is no longer malfunctioning, using the first configuration data to detect a second spoken input.

14. A system comprising:

at least one processor; and memory including instructions operable to be executed by the at least one processor to cause the system to:

store first configuration data corresponding to a first group of microphones that includes a first microphone and a second microphone;

store second configuration data corresponding to a second group of microphones that includes the first microphone but not the second microphone;

after storing the first configuration data and the second configuration data:

receive first audio data associated with a first microphone;

determine that a first energy level, associated with the first audio data, is within a first range;

based at least in part on determining that the first energy level is within the first range, determine the first microphone is functioning properly;

receive second audio data associated with a second microphone;

determine that a second energy level, associated with the second audio data, is outside of the first range;

based at least in part on determining that the second energy level is outside of the first range, determine that the second microphone is malfunctioning; and based at least in part on determining that the second microphone is malfunctioning, use the second configuration data to detect a first spoken input.

15. The system of claim 14, wherein the memory further comprises instructions that, when executed by the at least one processor, further cause the system to:

determine expected audio data corresponding to the second microphone;

determine, using the second audio data and the expected audio data, at least one of an attenuation value or a phase shift value associated with the second audio data; and determine that the second microphone is malfunctioning based on at least one of the attenuation value or the phase shift value.

16. The system of claim 14, wherein the memory further comprises instructions that, when executed by the at least one processor, further cause the system to:

after determining that the second microphone is malfunctioning, receive third audio data associated with the second microphone;

determine that a third energy level, associated with the third audio data, is within the first range;

based at least in part on determining that the third energy level is within the first range, determine that the second microphone is no longer malfunctioning; and based at least in part on determining that the second microphone is no longer malfunctioning, use the first configuration data to detect a second spoken input.

17. The system of claim 14, wherein:

the instructions to store the first configuration data further comprise instructions that, when executed by the at least one processor, further cause the system to store first beamformer coefficient data corresponding to the first group of microphones; and the instructions to store the second configuration data further comprise instructions that, when executed by the at least one processor, further cause the system to second beamformer coefficient data corresponding to the second group of microphones.

18. The system of claim 14, wherein:

the instructions to determine the first energy level is within the first range further comprise instructions that, when executed by the at least one processor, further cause the system to:

determine that at least a portion of the first audio data corresponds to a first energy value, the at least a portion of the first audio data corresponding to a first time range, and determine that the first energy value is above a threshold value; and the instructions to determine the second energy level is outside of the first range further comprise instructions that, when executed by the at least one processor, further cause the system to:

determine that at least a portion of the second audio data corresponds to a second energy value, the at least a portion of the second audio data corresponding to the first time range, and determine that the second energy value is below the threshold value.

19. The system of claim 15 wherein the instructions to determine the expected audio data further comprise instructions that, when executed by the at least one processor, further cause the system to:

generate the expected audio data using third audio data, output by the device, and a transfer function associated with the second microphone.

20. The system of claim 15, wherein the instructions to determine the expected audio data further comprise instructions that, when executed by the at least one processor, further cause the system to:

generate the expected audio data using input audio data associated with the second group of microphones.

* * * * *